US006195918B1

(12) United States Patent
Kelley et al.

(10) Patent No.: US 6,195,918 B1
(45) Date of Patent: Mar. 6, 2001

(54) GRINDING APPARATUS WITH FLEXIBLE PLATE

(75) Inventors: Benjamin B. Kelley, Redondo Beach; Christopher H. Morris, Topanga; David G. Inman, Fullerton, all of CA (US)

(73) Assignee: Artemis Innovations Inc., Torrance, CA (US)

( * ) Notice: Subject to any disclaimer, the term of this patent is extended or adjusted under 35 U.S.C. 154(b) by 0 days.

(21) Appl. No.: 09/442,019

(22) Filed: Nov. 17, 1999

Related U.S. Application Data

(63) Continuation-in-part of application No. 08/890,595, filed on Jul. 9, 1997, now Pat. No. 6,006,451, which is a continuation-in-part of application No. 08/799,062, filed on Feb. 10, 1997, now Pat. No. 5,970,631.

(60) Provisional application No. 60/022,318, filed on Jul. 23, 1996.

(51) Int. Cl.[7] ..... A43B 5/00; A43B 13/22; A43B 13/24

(52) U.S. Cl. ..... 36/115; 36/132; 36/114; 36/107; 36/72 A; 36/149; 36/136; 36/75 R

(58) Field of Search ..... 36/129, 132, 115, 36/114, 107, 72 A, 73, 108, 25 R, 148, 149, 152, 103, 116, 133, 136, 7.1 R, 76 R, 76 C, 72 R, 72 B, 75 R, 75 A, 82

(56) References Cited

U.S. PATENT DOCUMENTS

| | | | | |
|---|---|---|---|---|
| 702,476 | * | 6/1902 | Price | 36/72 R |
| 875,560 | * | 12/1907 | Vaughan | 36/72 R |
| 892,152 | * | 6/1908 | Harman | 36/72 R |
| 2,484,935 | * | 10/1949 | De Rooy | 36/72 R |
| 5,410,821 | * | 5/1995 | Hilgendorf | 36/100 |
| 5,970,631 | * | 10/1999 | Inman | 36/115 |
| 6,006,450 | * | 12/1999 | Hayes | 36/107 |
| 6,006,451 | * | 12/1999 | Morris et al. | 36/115 |
| 6,041,525 | * | 3/2000 | Kelley | 36/115 |
| 6,115,946 | * | 9/2000 | Morris et al. | 36/115 |

* cited by examiner

*Primary Examiner*—Paul T. Sewell
*Assistant Examiner*—Anthony Stashick
(74) *Attorney, Agent, or Firm*—Fulwider Patton Lee & Utecht, LLP

(57) ABSTRACT

Grind shoe device of the present invention includes a shoe sole having downwardly facing heel and forefoot tread surfaces and a downwardly opening recess formed with longitudinal and transverse recess sections. A grind plate device is formed with transverse and longitudinal grind plate sections for receipt in the respective transverse and longitudinal recess sections, at least one of such grind plate sections being formed with a downwardly facing trough for grinding along a rail, curb or the like. The longitudinal grind plate section is flexible and in some embodiments is foiled of rigid sections of discrete rigid grind plate portions disposed to flex relative to one another to facilitate flexing of the sole. The method of the present invention involves the manufacturing of the sole with such downwardly facing recess and fabricating the grind plate device to be complementally received in its top side in such recesses. The grind plate is fastened to the sole by bonding, molding or, in some instances, by mechanical fasteners.

50 Claims, 19 Drawing Sheets

FIG. 39
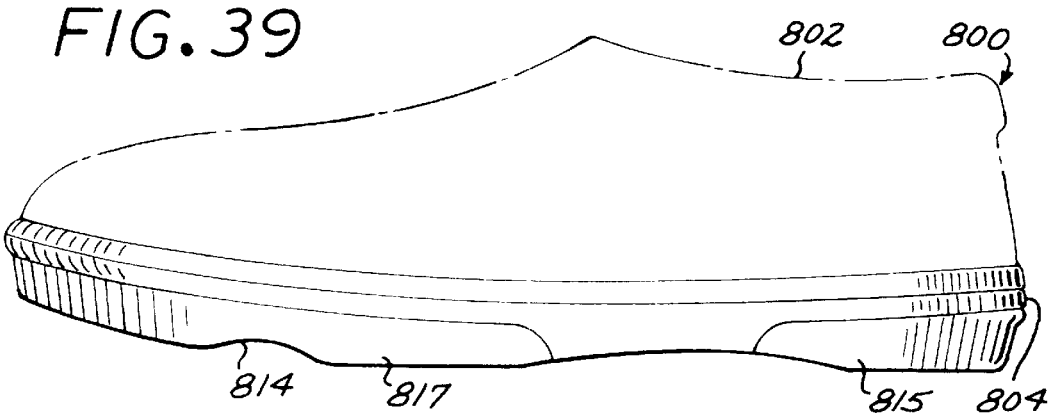
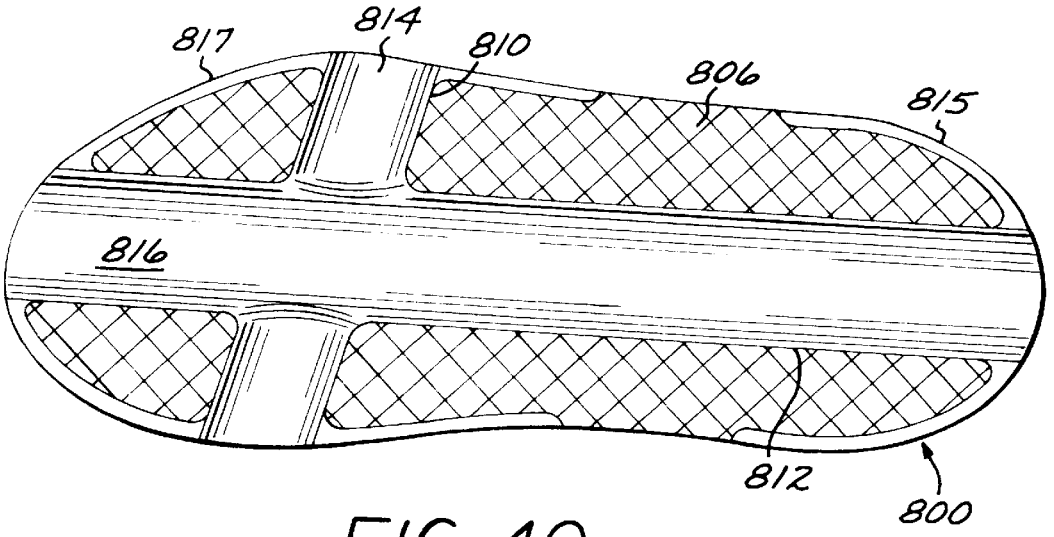
FIG. 40

GRINDING APPARATUS WITH FLEXIBLE PLATE

This application is a Continuation-in-Part of application U.S. patent application Ser. No. 08/890,595, filed Jul. 9, 1997 now U.S. Pat. No. 6,006,451 which was a Continuation-in-Part of Ser. No. 08/799,062, filed Feb. 10, 1997, now U.S. Pat. No. 5,970,631, issued Oct. 26, 1999, claiming priority of Provisional Application Ser. No. 60/022,318 filed Jul. 23, 1996, all of which are incorporated herein by reference.

BACKGROUND OF THE INVENTION

1. Field of the Invention

The present invention relates to grinding shoe devices employed by athletes to grind along rails, curbs or the like.

2. Description of the Prior Art

With the current popularity of grinding activities involving athletic shoes with grinding plates mounted on the bottom side thereof, many efforts have been made to provide a satisfactory grinding shoe. In an earlier patent application owned by the same Applicant, Ser. No. 08/799,062, filed Feb. 10, 1997, and now U.S. Pat. No. 5,970,631, issued Oct. 26, 1999 we proposed grind shoe devices including various configurations involving grind plate sections mounted under the arch and grind plate sections extending longitudinally of the shoe sole. In our co-pending U.S. application Ser. No. 09/333,612, filed on Jun. 15, 1999, we address the basic configuration of a cruciform grinding plate mounted on a shoe for providing the athlete with foot positions in both the direction of travel and perpendicular to the direction of travel. Such grind shoe devices have provided solutions to many of the problems associated with the desire for a satisfactory grind shoe. It has been discovered that the performance of grinding shoes may be enhanced by the provision of uniquely configured, longitudinally extending grind plate sections which are formed along their length with independently flexible sections or sometimes with discrete separate portions so that longitudinal flexing is facilitated during walking and running maneuvers and even during some grinding activities. It is these features as illustrated herein for exemplary purposes in FIGS. 17–20, and 28–52 to which the present invention is directed.

Further advantages of the grinding device of the present invention is that the longitudinal grind plate section is placed under the sole of the shoe in advantageous positions and orientations for various unique grinding activities. These advantages will be apparent to those skilled in the art from the following detailed description of the invention.

SUMMARY OF THE INVENTION

The present invention is characterized by a grinding shoe device formed with a shoe sole having downwardly opening longitudinal recesses configured for receipt of longitudinal grind plate sections which are flexible in the longitudinal direction to facilitate the walking and grinding maneuver. Such flexibility may be achieved by hinge elements formed at various locations along the length of the grind plate device or may even be formed by configuring the longitudinal grind plate with discrete portions defining therebetween transverse flex lines for the sole itself. The sole may be formed with transverse hinge lines aligned with the juncture of the various discrete plate portions.

BRIEF DESCRIPTION OF THE DRAWINGS

FIG. 39 is a medial side view of a modification of the grinding shoe apparatus shown in FIG. 17;

FIG. 40 is a bottom plan view of the grinding shoe apparatus shown in FIG. 39.

DESCRIPTION OF THE PREFERRED EMBODIMENT

As described in our U.S. patent application Ser. No. 08/890,595 filed on Jul. 9, 1997 and now U.S. Pat. No. 6,006,451, and U.S. patent application Ser. No. 08/799,062 filed on Feb. 10, 1997 and now U.S. Pat. No. 5,970,631 grinding shoes have filled a void left by grinding or sliding over support surfaces while relying on skateboards or roller blades. Those grinding devices generally incorporated a shoe sole, typically cushioned, with a cavity into which a slide plate is recessed to enable the user to perform grinding maneuvers. The athlete can then employ the grinding shoe to perform grinding maneuvers as well as Such common daily activities as exorcising, walking, running, and working. In the most basic configuration, those grinding devices incorporate a slide plate that is attached within the bottom surface of a shoe sole to present a low friction, downward facing surface to slide along a support rail and the like. As fully described below, the different designs and implementations of the present invention do not interfere with the normal walking or running gait cycle of the user which is advantageous over the use of either skateboards or rollerblades.

As the athletes continue to gain experience or encounter different Support surfaces, their desire for alternative grinding shoe configurations capable of new maneuvers arises. For instance, some support surfaces such as rails or curbs may have a number of variably inclined adjacent surfaces which require flexibility in the longitudinal direction to significantly enhance the sliding experience during the transition from one degree of inclination to another. It is advantageous in certain situations to maintain contact with as much of the sliding surface with the support surface as possible. As such there may be a desire for keeping a significant portion of the grinding surface on the support surface or alternatively to flex one's foot about a transverse axis as new inclinations are encountered. The apparatus of the present invention provides an alternative configuration to enable a new series of sliding maneuvers to keep pace with desires of the athletes. At other times, it is desirable to be able to significantly flex one's foot and it will therefore be advantageous to provide a longitudinal plate that may flex with the sole of the shoe, especially during activities such as running. In other words, the present invention addresses the needs of today's grinding athletes who may encounter both variably inclined surfaces and demand additional performance in the grinding shoe while running in preparation to slide over a support surface. It must be understood that while each of the figures that accompany the disclosure depicts an article of footwear that is meant to be used on the left foot of a user, every embodiment disclosed herein is equally adaptable to use on the right foot of a user.

Figure 1:
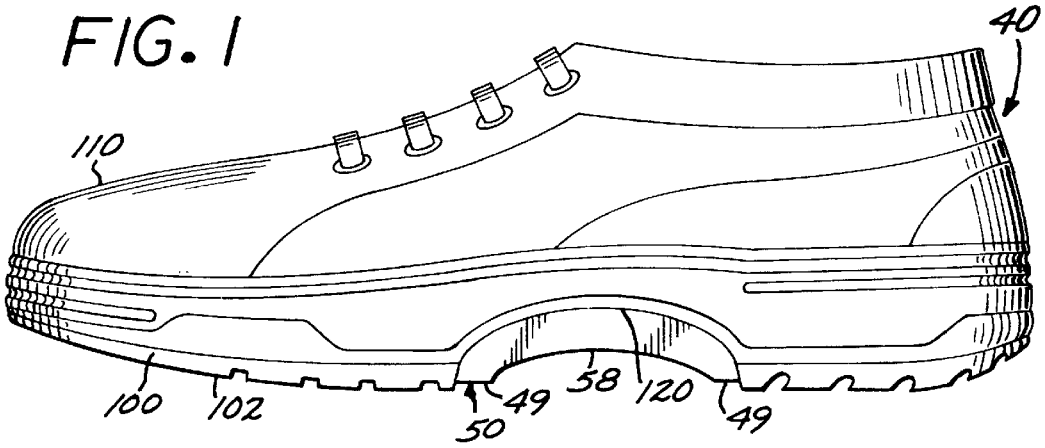
FIG. 1 is a side view of footwear apparatus for the left foot with a slide plate according to the present invention.

Referring to FIG. 1, the preferred embodiment of the present invention is comprised of an athletic shoe 40, that is, a shoe adapted in design and manufacture for activities involving running and jumping, and is commonly understood to include shoes such as running, cross training, aerobics, basketball, tennis, skateboarding and other similar shoes. The shoe 40 shown in the exemplary embodiment is a left shoe and includes, generally, an upper 110 mounted to a sole 100 formed with a cavity 120 extending across the arch region of the bottom surface 102 of such sole. The upper 110 may be formed from leather, canvas, plastic or any other material known in the art to provide the necessary strength and flexibility to enclose the user's foot. To fasten around the user's foot, the upper 110 may be provided with laces, Velcro™ hook and loop fasteners, or any other convenient fastening devices. The upper 110 may be mounted to the upper surface of the sole 100 by any workable method, including sewing the upper to the sole with thread, bonding with glue or epoxy, directly injecting, fusing, welding, molding the two pieces together, or any combination thereof.

Figure 3:
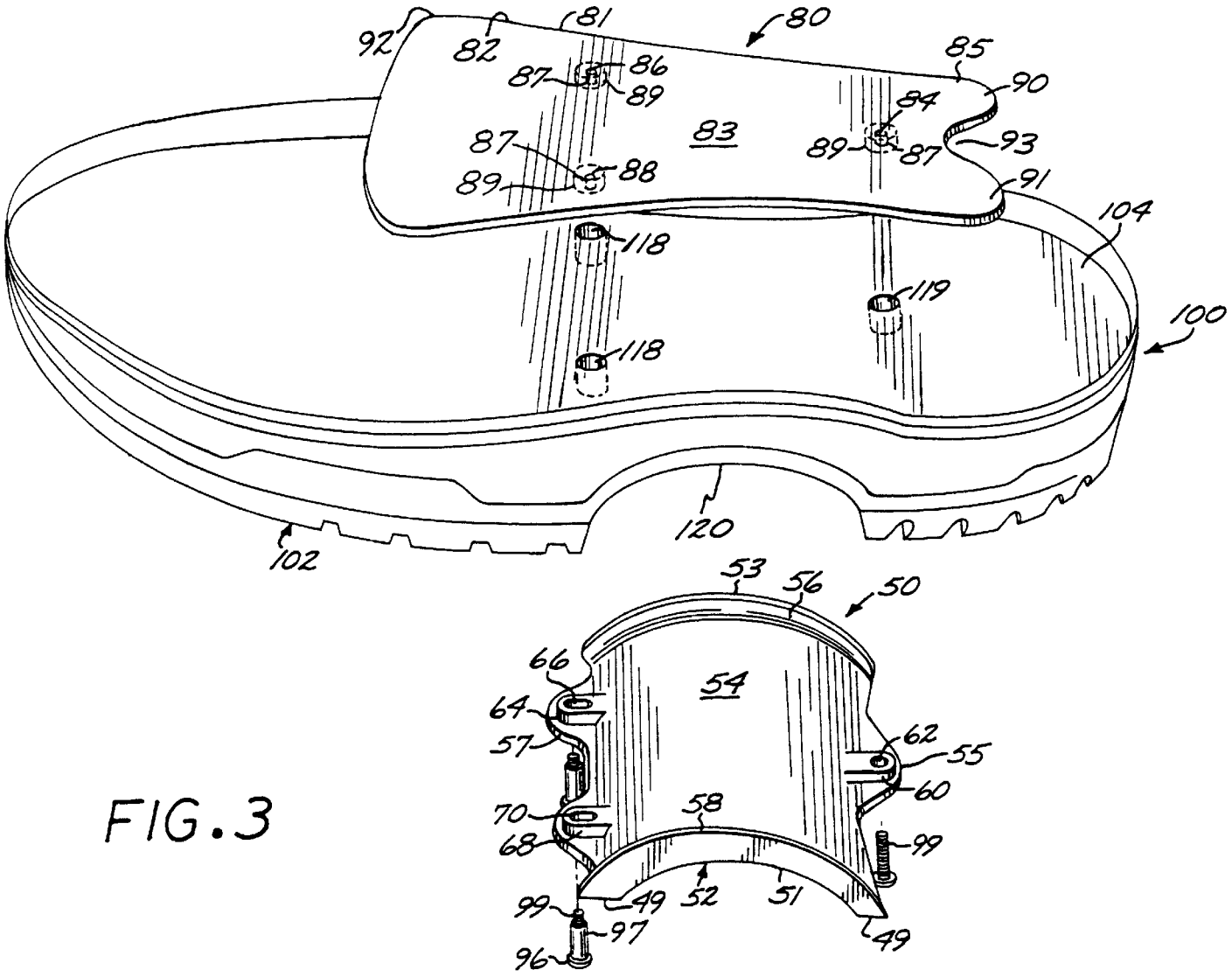
FIG. 3 is an enlarged scale exploded perspective view of the slide plate, sole and anchor plate assembly mounted to the footwear apparatus shown in FIG. 1.

As shown in FIG. 3, an arcuate slide plate 50 formed by a shaped sector of a cylindrical wall is configured with a convex upper surface 54 conforming substantially to the cavity 120 and a concave bottom surface in the form of a downward facing, substantially semi-cylindrical trough 52, and is fastened within such cavity 120. The sole 100 must be of sufficient thickness to accommodate a cavity 120 sized to retain the slide plate 50 at a depth of preferably 9 mm as measured between the high point of the trough 52 of the slide plate and the underlying horizontal supporting surface (herein after "rise"). It has been found that a rise ranging between 6 to 15 mm allows a relatively modest vertical profile for the shoe 40 (FIG. 1) while providing the necessary support to the arch of the foot as well as sufficient curvature to perform grinding maneuvers. A higher rise of approximately 13 mm is ideal, but the extra support provided by such a rise may be sacrificed in favor of a thinner sole 100 and a lower overall profile for the shoe. A sole 100 of about 27 mm to 35 mm in thickness, as measured along the longitudinal axis of the sole, has been found to accommodate a cavity of sufficient depth to allow for a slide plate 50 rise of 9 mm. The bottom surface 102 of the sole 100 that comes into contact with the supporting surface during the user's gait cycle may be formed with any tread pattern as dictated by the athletic functions the user of the shoe 40 (FIG. 1) intends to perform in addition to grinding, such as walking, running, jumping, etc.

Referring again to FIG. 3, the cup 104 of the sole 100 is further formed with two anterior laterally spaced apart through bores 118. The sole 100 is preferably compression molded from rubber heated to its glass transition temperature while applying pressure to conform the rubber into a mold bearing the desired sole configuration. Other materials such as leather, plastic or polyurethane may also be employed, but rubber is preferred for its abrasion resistance and relatively high coefficient of friction, both highly desirable characteristics for the soles of footwear. In addition, rubber is shock absorbent and greatly increases the comfort of the wearer by cushioning the foot from the impact of walking or running. Rubber can be easily cast in a variety of complex shapes and in any desired thickness, and can therefore be manufactured to accommodate practically any slide plate configuration. Furthermore, rubber can also be cast in varying degrees of hardness, and can be manufactured in any color and practically any surface pattern to appeal to the aesthetics and fashion sense of different market segments.

Most other materials typically used to manufacture shoe soles, while offering some or most of the desired characteristics, also have one or two drawbacks that render them less than ideally suited to the present application. Leather, for instance, offers excellent wear resistance and flexibility, but is difficult to form in the required thickness, has a relatively low coefficient of friction, and forming hollow cavities with complex configurations in a leather sole would place great demands on the craftsman and be labor intensive. Similarly, while plastic can be cast in almost any shape and exhibits relatively high wear resistance, compromises in plastic soles involves flexibility and resiliency, and so are typically not as comfortable as rubber soles.

Figure 2:
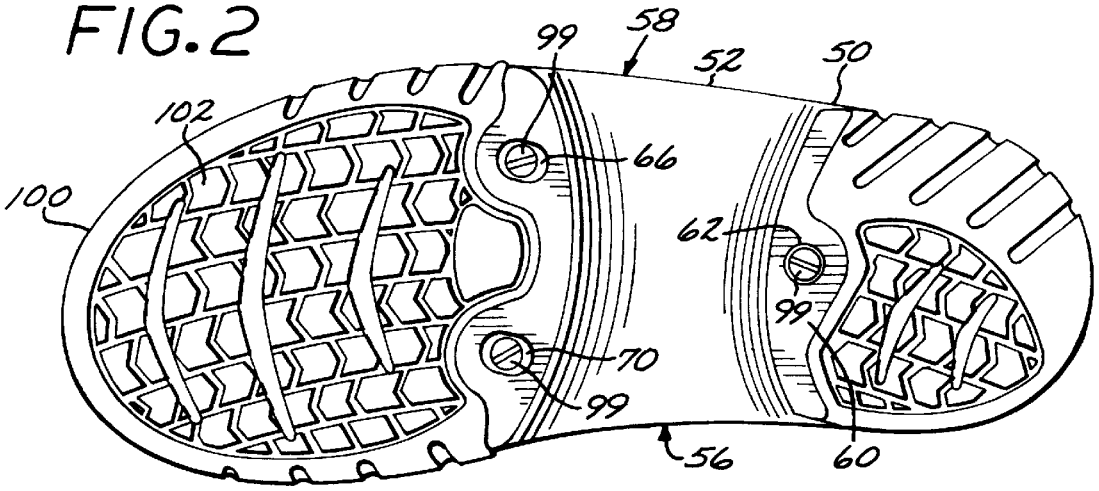
FIG. 2 is a bottom view of the footwear apparatus Shown in FIG. 1.

With reference to FIGS. 2 and 3, the slide plate 50 is comprised of, in plan view, a four sided, generally trapezoidal monolithic body configured as a sector of a cylinder having a wall thickness of approximately 8 mm to provide sufficient structure to withstand shock and present sufficient body to endure considerable wear. The lateral side is configured to project in a generally straight line extending in the longitudinal fore-aft direction or in a direction angling forwardly and laterally at an angle up to about 5° to the fore-aft direction. The medial side angles forwardly and medially at an angle of about 15° from the fore-aft longitudinal direction to generally complement the cut of the medial instep of the sole of a conventional shoe. The bottom trough 52 is preferably formed with a smooth surface, generally semi-cylindrically spaced at the height of such trough with a radius of curvature of about 12 cm and flares upwardly at the opposite sides. The cylindrically shaped slide plate terminates at its anterior and posterior ends in downwardly facing edges 49 disposed in a horizontal plane spaced vertically above the horizontal plane including the horizontal bottom tread surface 102 defined by the bottom of the sole 100. The slide plate 50 is constructed of a material selected to afford the desired low coefficient of friction sliding characteristic, as well as high abrasion resistance to withstand repeated sliding across abrasive supporting surfaces such as concrete. The slide plate must sustain sliding over an extended length of a vertical supporting surface and over the entire length of a downwardly sloping surface such as a typical staircase handrail, and the coefficient of friction should therefore be sufficiently low to allow the force created by gravity to cooperate with the forward momentum of the guide to overcome the frictional resistance of a rail, concrete curb, and the like. In addition, the material selected must offer substantial rigidity when injection molded in the dimensions specified in the disclosure to allow the user to maintain control while engaged in grinding maneuvers, because any undue flexing while sliding would adversely impact the user's ability to receive feedback from the reaction forces applied to the underside slide plate 50 and control its direction. A material known to exhibit these desirable characteristics is Supertuf 801 Nylon available from Dupont. Other materials that may be found to be acceptable include other forms of nylon, such as Nylon 6, plastics such as PTEX, hard rubbers, glass, ceramics, metals, polyethylene and composites. While a substantially rigid slide plate is preferred, those skilled in the art will realize that further embodiments of this apparatus may incorporate more flexible slide plates in order to appropriately tailor performance characteristics to meet the requirements of various grinding surfaces or grinding maneuvers.

Referring to FIG. 3, the configuration of the upper surface 54 of the slide plate 50 is an approximate mirror image of the bottom surface in a slightly larger radius of curvature and is upward facing, convex, and substantially semi-cylindrical. The upper surface 54, however, is not critical to the practice of the invention and may be configured in any shape as may be dictated by practical or aesthetic considerations to nest in the corresponding cavity in the bottom of the shoe sole. One such practical consideration of considerable importance is the fact that the upper surface of the slide plate is received complementarily in a cavity formed in the shoe sole. It is advantageous if the configuration of this cavity does not require complex manufacturing steps. It is also desirable that the cavity in the sole does not adversely impact the characteristics of the sole, such as support, stability, safety, comfort, and strength. Thus, for example, an overly convex slide plate upper surface may necessitate an especially deep cavity in the sole that will dictate a very thick sole or else a very thin arch area that would offer only limited support and become prone to failure after a short service life. Similarly, a multi-faceted and angular slide plate upper surface may require additional manufacturing or finishing steps before the sole can be used in the final assembly. It has been found that the slide plate upper surface design of the present embodiment does not necessitate the use of an overly thick sole in the shoe, is relatively simple to manufacture, and cooperates with the arch of the sole to provide a supportive and comfortable platform for the user's foot.

As shown in FIG. 3, the top surface 54 of slide plate 50 is somewhat saddle shaped to curve upwardly in hyperbolic fashion at the opposite sides and is configured with respective medial and lateral raised arcuate, high performance rails 56 and 58 which cooperate to retain the foot centered over such plate and form respective outwardly facing curved slide runners 51 and 53 for gliding contact with the support surface when the shoe is laid over on its side. Such rails raise upwardly about 5 mm above the major top surface of such plate. The rearward edge of the slide plate is forced with a mounting flange 55 configured with a centrally disposed, rearwardly projecting posterior anchor tab 60 configured with a through bore 62 aligned with the anchor bore 119 in the sole cup 104 and constructed on its bottom side with a downwardly opening countersunk recess. The slide plate is further formed at its anterior end with a forwardly projecting mounting flange 57 configured with a pair of laterally disposed anterior float tabs 64 and 68 formed with through, longitudinal slide slots 66 and 70 configured to be disposed in alignment beneath the anterior bores 118 in such sole 100. The slide slots 66 and 70 are configured on their bottom sides with longitudinally extending countersunk recesses. The posterior flange 55 anterior and flanges 57 are about 3 mm thick and the mounting tabs 60, 64, and 68 are approximately 6 mm thick.

Still referring to FIG. 3, one embodiment of the present invention also includes an anchor plate, generally designated 80 overlying the mid-sole and which may be in the form of a generally horizontal hard plastic foot frame 82 and having a swallow-tail shaped, rearwardly projecting heel portion 85.

The foot frame 82 is configured in plan view with a wide, relatively thick forward control section 81 disposed forwardly under the arch of the foot and bulging medially outwardly and laterally outwardly forward of the two anterior bosses 89. The edges thereof then curve forwardly and laterally inwardly to a form a thin rounded forward edge 92. The medial and lateral edges of the foot frame project rearwardly from the forward control section 81 to form an arch section 83 and a heel section 85 configured with outwardly flared rearwardly projecting tail sections 90 and 91 configured somewhat in the form of a swallow's tail and arranged to form therebetween a generally V-shaped rearwardly opening notch 93 disposed to the sides of the heel bone.

It will be appreciated by those skilled in the art that the bulk of the user's foot control is exhibited generally over the central arch section 83. To facilitate this control, the major rigidity in the foot frame is formed in the mid-foot section 83 which prevents excessive convex flexing of the foot and provides support to the user in the act of grinding. In addition, three bosses 89 triangulated about the mid-foot section of the foot frame 82 cooperate to react torsional loading. The foot frame 82 projects forwardly approximately 3.5 cm from the control section 81 having a major width of 7.5 cm to form a rounded forward end 92 configured to control the flexibility of the forward portion of the shoe. Such plate tapers laterally rearwardly from such control section 81 to a width of about 5.5 cm for the heel section 85. The V-opening notch 93 is cut at a longitudinal depth of about 1.8 cm into the body of the foot frame itself and acts to prevent contact between the heel bone and the foot frame. The control section 81 is formed with a thickness of 2 mm and the thickness of the foot frame tapers gradually forwardly from the two anterior bosses 89 to a minimum thickness of about 1 mm. The control section 81 is formed with two laterally spaced bolt sockets 86 and 88 aligned over the slide slots 66 and 70 formed in the float tabs 64 and 68 and the heel section 85 is formed with a central bolt socket 84 disposed over the anchor tab 60. The foot frame is formed with two anterior and one posterior downwardly depending cylindrical bosses 89 configured with upwardly opening sockets which receive respective insert molded threaded tubular brass or stainless steel inserts 87 aligned under the respective bolt sockets 84, 86, and 88.

Referring once again to FIG. 3, the foot frame 82 is oriented such that the bolt sockets 84, 86 and 88 are disposed directly over and coaxial with the corresponding front through bores 118 and anterior through bore 119 formed in the sole 100, and the corresponding through bore 62 and slide slots 66 and 70 formed in the slide plate anterior and posterior mounting tabs 64, 68 and 60.

Referring to FIGS. 1, 3, 6 and 7, the posterior bolt socket 84 and anterior bolt sockets 86 and 88 together with the posterior through bore 62 and slide slots 66 and 70 cooperate with the anterior through bores 118 and posterior through bore 119 formed in the sole 100 of the shoe 40 to receive button head shoulder screws 99 to secure the slide plate 50, shoe 40, and foot frame 82 together in a snug, rattle free configuration by threading the fasteners into the threaded brass inserts 87 secured within the foot frame 82. The screws are preferably Nylock® self locking screws of 4 or 5 mm shaft diameter, approximately 12 mm head diameter, and varying length as dictated by the overall height of the slide plate anchor tab 60 and float tabs 64 and 68, shoe sole 100, and bosses 89. The shafts 97 of the screws 99 are received through the forwardly projecting tab slide slots 66 and 70 and are sandwiched between the bottom end of the respective bosses 89 and annular shoulder of respective buttons the heads 96 of the fasteners.

The shoulder screws 99 are sufficiently long to act as spacers to, when the screws are fully tightened, stand the shoulders of the respective button heads 96 about 1 mm off from the overlying bottom surface in the respective countersinks in the respective anterior float tabs 64 and 68 to provide some play for such tabs and allow relatively free floating thereof. Screws of various lengths and or materials such as elastomers may be used to accommodate different slide plate materials and thicknesses, giving the user the ability to adjust performance characteristics of the slide plate to match the requirements of different grinding surfaces.

The slide plate 50 is next selected and inserted within the cavity 120 of the shoe sole 100, where it is secured by threading the screws 99 through the slide slots 66 and 70 and the through bore 62, on through the corresponding through bores 118 and 119 formed in the shoe sole, and into the anchor plate threaded inserts 87 made of brass, stainless steel or other materials. The screws are conveniently provided with engagement slots or sockets formed in the top surface of the heads 96 for engagement by a screwdriver or other tool for quick and easy turning of the screws. Alternatively, or in addition, high strength adhesives such as epoxy may be employed to fasten the slide plate to the surface of the sole cavity in a permanent configuration that sacrifices slide plate interchangeability for a stronger, more secure bond.

Slide plates 50 can be manufactured in a variety of styles to fit a variety of uses, and the rapid replacement feature detailed above enables quick swapping of slide plates to accommodate varying conditions and surfaces. The slide plates can thus be manufactured from different materials that will provide varying degrees of abrasion resistance and sliding ability to accommodate such different surfaces as, for example, concrete curbs and steel handrails. In this manner a user may choose, for example, a certain slide plate for grinding on a steel handrail and a different slide plate offering improved abrasion resistance when grinding on a concrete surface, and may also choose to install one type of slide plate on the right shoe and a different type of slide plate on the left shoe.

Slide plates 50 may also be formed with different downward facing configurations, and thus a slide plate adapted for steel rails may feature a narrower sliding surface 52 with higher performance rails 56 and 58, whereas a slide plate for concrete curbs may feature a wider, flatter sliding surface flanked by low side walls. In addition, slide plates may be manufactured in different colors that appeal to the fashion sense of the user, and individual slide plates may be formed with strata of different colors to indicate the level of wear upon the plate and thus aid the user in determining when the slide plate should be replaced.

In operation, when a user desires to participate in a grinding exercise, he or she may put on the shoe and can walk or run in the normal fashion. The slide plate is sufficiently recessed upwardly from the bottom surface of the sole 100 to reduce contact with the supporting surface.

Figure 4:
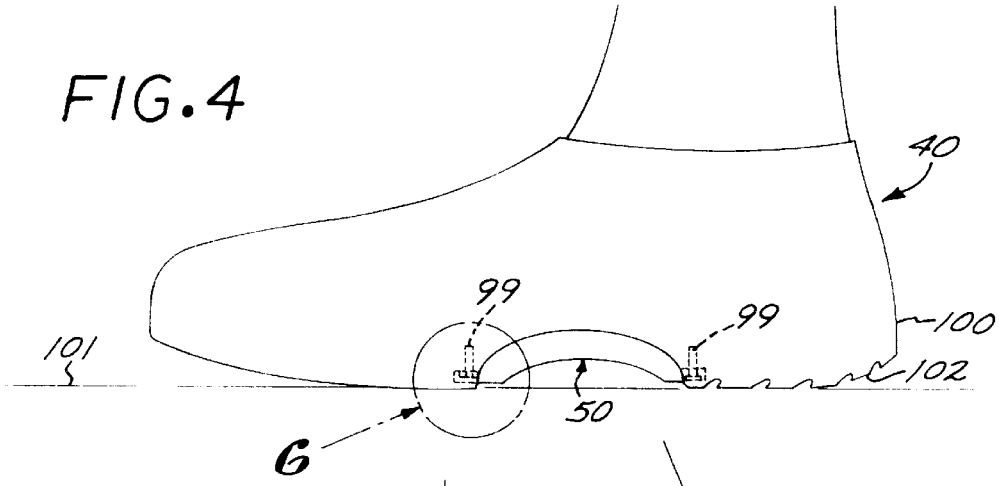
FIG. 4 is a side view of the footwear apparatus shown in FIG. 1 in operation during a walking gait with the entire sole contacting the ground.
Figure 5:
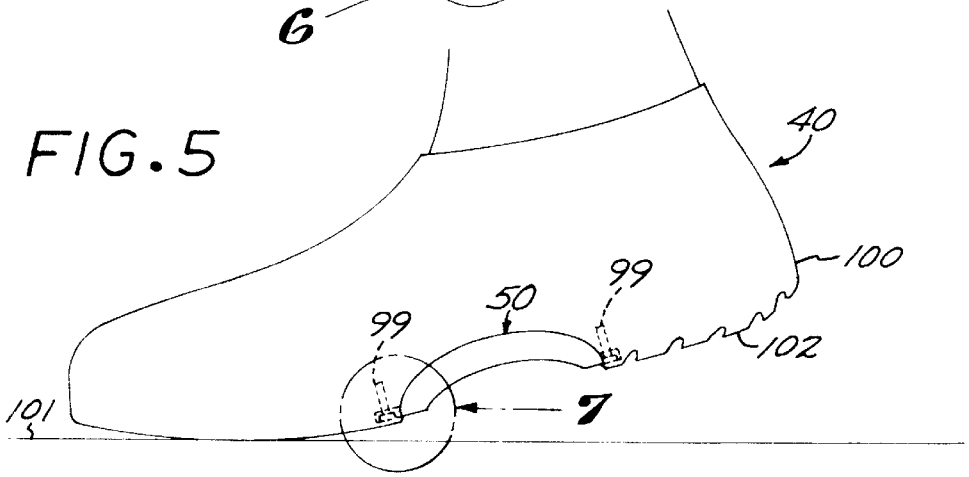
FIG. 5 is a side view of the footwear apparatus shown in FIG. 1 in operation during a walking gait with the forefoot portion of the sole contacting the ground.
Figure 6:
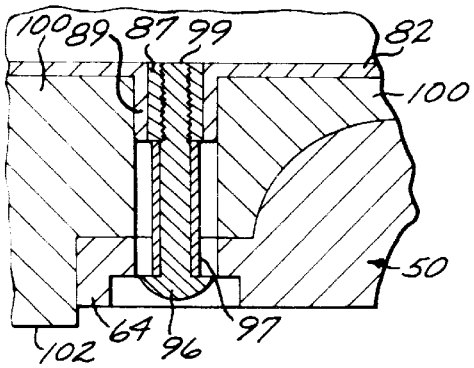
FIG. 6 is an enlarged section view of the front edge of the slide plate of the present invention shown in FIG. 4.
Figure 7:
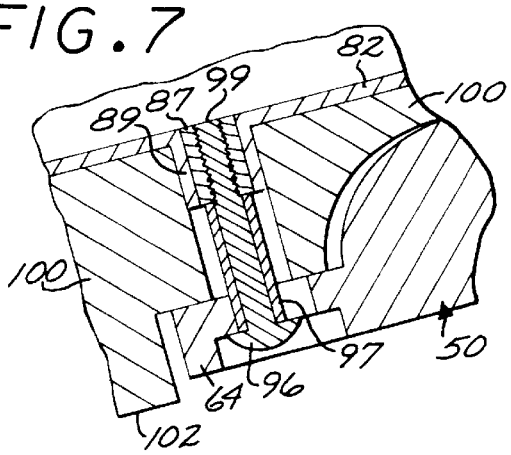
FIG. 7 is an enlarged section view of the front edge of the slide plate of the present invention shown in FIG. 5.

Referring now to FIGS. 4 and 5, as the user walks or runs along a sidewalk 101 or playground, the sole 100 of his or her shoe and the foot frame 82 will flex with each step taken to accommodate the bending of his or her feet, and the bottom surface 102 of each sole will therefore alternately expand and contract to accommodate this movement. Because the normal gait of an upright human involves first contacting the heel of the shoe and then rolling forwardly onto the ball of the foot and then lifting the heel up, most of the accompanying flex in the sole is localized in the forward and metatarsal area of the foot. As shown in FIGS. 6 and 7, the present invention is designed to accommodate this flexing by anchoring the slide plate 50 to the heel portion of the sole 100 through the posterior anchor tab 60 and allowing the front of the slide plate to float relative to the front screws 99 by sliding of the float tabs rearwardly on such screws through the elongated slide slots 66 and 70 as the sole flexes when the heel is drawn upwardly and rearwardly to flex in somewhat of an are as the heel is raised relative to the ball of the foot. The shoulders of the screws prevent the screw heads 96 from coming in contact with the bottom of the counter bored recesses in the anterior mounting tabs 64 and 68, and thereby serve to minimize wear and tear on the slide plate 50. The screw heads 96 are counter bored within the slide plate 50 and do not come into abrasive contact with the grinding surface, and therefore can be reused when the slide plate is replaced. The slide plate of the present invention thus allows the sole of the shoe to function along the supporting surface in the manner typical to most Footwear and does not force the user to change her normal gait, unlike other specialized articles of footwear such as ski boots whose narrowly focused design comes at the expense of the basic functions of walking and running. The present invention therefore provides a single shoe apparatus that is equally adapted to the distinct functions of walking, running and sliding, and unites the two activities seamlessly with no loss of functionality or comfort.

It will be appreciated by those skilled in the art that the gradually increasing flexibility of the foot frame 82 forwardly of the control section 81 toward the forward end 92 of the foot frame will distribute flexure of the sole 100 forwardly of the slide plate 50 for comfortable walking or running, and will serve to prevent the tendency of such sole to flex primarily just along a transverse line immediately forward of the front edge of such plate 50 to thereby avoid the tendency of such sole to over-flex, which over time, would form a weakening crease at that location and would allow debris to enter. Likewise, the foot frame will tend to distribute flexure of the sole rearwardly to thereby accommodate normal walking and running steps while avoiding the tendency to form a weakening crease at the rear of the slide plate 50. Additionally, the V-shaped opening 93 beneath the heel bone positioned above a shock absorbing plug 445 (FIG. 26) will provide for cushioning of the heel bone directly against the sole 100 to thereby minimize bruising and injury.

It will be appreciated that in a highly athletic activity involving, for instance, an aggressive grinding maneuver wherein the athlete might jump with some force onto a hand rail, pipe or similar elongated surface, the landing force of the athlete may be several magnitudes greater than the weight of the athlete, i.e. exceeding eight times the weight of the athlete. As an athlete jumps onto, for instance, a pipe, the pipe will typically be received in the downwardly opening trough 52 of the slide plate 50 and more often than not the athlete will endeavor to land in a position causing the initial impact to be received on the medial rearward end of such plate in the area of the posterior mounting flange 55. The slide plate 50 of the present invention has sufficient structural integrity to withstand such impacts and also accommodate the wear resulting from such plate sliding laterally over the surface of such underlying pipe. It is also of benefit that the force of the athlete's impact will exert forces downwardly through the saddle shaped plate 50 in a manner which will cause the upturned, upwardly curved lateral edges thereof to nest the shoe sole and foot even more firmly in a laterally centered position within the saddle shape of the plate.

As the athlete maneuvers in a gliding action along such pipe, he or she can maneuver the foot about to maintain control or execute further acrobatic maneuvers. In this regard, it will be appreciated by those skilled in the art that the foot frame 82 provides for torsional flexure while maintaining a secure coupling to the slide plate 50 to thereby impart control from the user's foot to the shoe sole and into the slide plate 50 for positive control thereof. The foot frame also serves to distribute vertical forces laterally and longitudinally.

When the wearer elects to undertake a maneuver requiring a crouch position, he or she may bend the knees into a deep bend and lay one knee over medially which will involve inclining the slide plate 50 to a laterally inclined position, up to an incline approaching 75° or 80° from the horizontal. In this maneuver, the arcuate medial rail 56 will carry the entire weight placed on that foot of the user and the outwardly facing runner 53 will slide along the underlying pipe, again keeping the plate centered over the top of such pipe.

Figure 8:
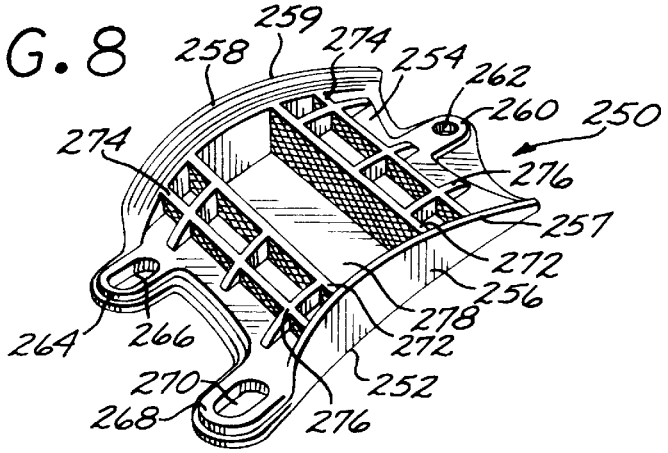
FIG. 8 is a perspective view of a second embodiment of a slide plate according to the present invention.

In a further embodiment of the present invention (FIG. 8) a slide plate, generally referred to as 250, is formed by a four sided, generally trapezoidal monolithic body 254 configured with a downward facing, concave, substantially semi-cylindrical trough 252, and upturned, laterally disposed arcuate side walls 256 and 258 terminating at their respective upper extremities in arcuate retainer rails 257 and 259, respectively. The anterior extremity of such plate is formed with a contoured mounting flange configured with a pair of laterally spaced apart anterior float tabs 264 and 268, including respective elongated slots 266 and 270. The posterior extremity of such plate is formed with a contoured mounting flange configured with a central, rearwardly projecting anchor tab 260 including through bore 262. The body of such plate is formed with a rectangular rib network defining respective laterally projecting inner ribs 272 and outer ribs 274 terminating at their respective upper edges flush with the upper edges of the arcuate rails 256 and 258. Longitudinal ribs 276 extend from each lateral inner rib 272 through each respective lateral outer rib 274. Formed between the inner ribs 272 and side rails 256 and 258 is a rectangular open top storage compartment 278 where users might store money or the like.

Figure 9:
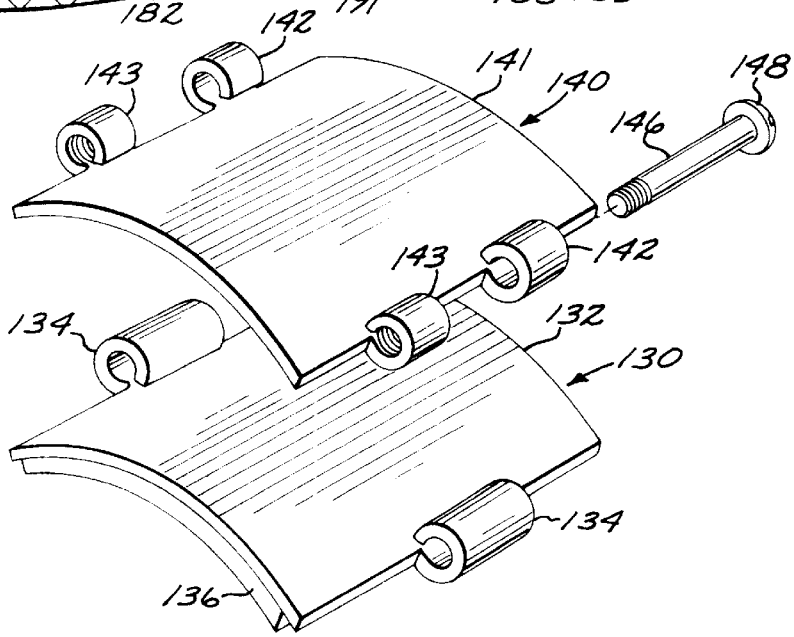
FIG. 9 is an exploded perspective view of a third embodiment of a slide plate and base plate assembly according to the present invention.
Figure 10:
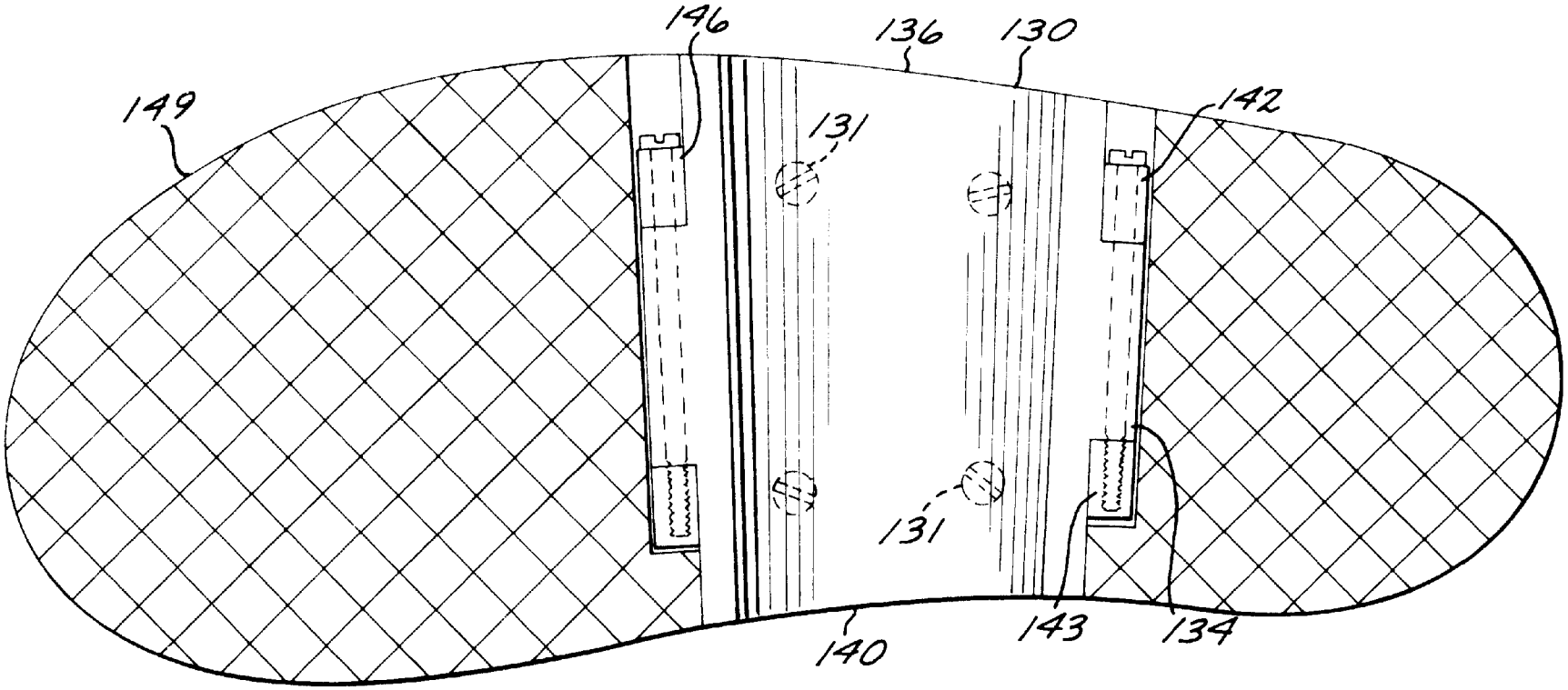
FIG. 10 is a bottom view of footwear apparatus with a slide plate as shown in FIG. 9, shown in double scale for clarity.

Referring to FIGS. 9 and 10, in an alternative embodiment of the present invention, the slide plate apparatus, generally designated 130, is constructed to be fastened to a base plate, generally designated 140, mounted within a complementarily shaped cavity formed in the sole of an article of footwear. The base plate 140 is comprised of a generally rectangular plate 141 formed in a concave, semi-cylindrical configuration with pairs of laterally aligned, forwardly and rearwardly disposed, cylindrical mounting barrels 142 and 143 for receipt of respective coupling pins 146. The barrels 143 are threaded for securing thereto of the respective threaded tips of pins 146. Such pins are formed with respective retainer heads 148.

The base plate 140 may be formed from any material that offers the preferred characteristics of stiffness and light weight, including plastics, metals, ceramics, and composites. Depending on the material of construction, the cylindrical barrels 142 may be formed by hot or cold rolling planar extensions of the base plate into the requisite cylindrical shape, or may be formed separately and then secured to the edges of the base plate 140. The base plate 140 is ideally of the minimum thickness required by the chosen material of construction to maintain stiffness.

With continued reference to FIG. 9, the slide plate 130 is comprised of a generally rectangular in plan view, concave, semi-cylindrical plate 132 configured with an upper surface of substantially complementary shape to the lower surface of the base plate 140. Two opposing edges of the slide plate 130 corresponding to the mounting edges of the base plate 140 are each equipped with a centrally disposed, upwardly turned, laterally projecting mounting tabs defined by a cylindrical barrel 134 of length equal to the distance between adjacent base plate cylindrical barrels 142 and 143 for sliding receipt therebetween. The slide plate barrels 134 extend parallel to the respective front and rear edges of the slide plate 130.

The downward facing surface of the slide plate 130 is equipped with a low friction, high abrasive resistance layer 136 that presents a downward facing, concave, semi-cylindrical lower surface for slidably engaging a supporting surface. The low friction layer may be attached to the slide plate by any means of sufficient mechanical strength to withstand the shear forces generated during grinding maneuvers, such as chemical bonding. The lower surface of the low friction layer may be formed with a smooth, continuous configuration, or alternatively may be configured with ribs or other protuberances that reduce total sliding area and thus total frictional resistance. Alternatively, the entire slide plate 130 may be formed from a low friction material exhibiting sufficient stiffness and mechanical strength to be directly attached to the base plate 140.

Referring to FIG. 10, in operation the base plate 140 is secured within the complementary shaped cavity formed in the sole of the shoe. The base plate 140 may be secured directly to the sole 149 through any practicable means including chemical bonding or mechanical fasteners, and may used in conjunction with an anchor plate as described previously and illustrated in FIG. 3. The embodiment illustrated in FIG. 10 employs four screws 131 to mount the base plate 140 to the sole 149. The base plate 140 is preferably recessed within the sole cavity at a depth sufficient to reduce contact by the slide plate 130 with the supporting surface when the slide plate is attached to the base plate. This is an important consideration to prevent interference with the user's normal gait cycle, as explained previously in the disclosure.

The user may next select a slide plate 130 having the desired low friction layer 136, mounts the slide plate adjacent to the base plate 140 with the slide plate mounting barrels 134 disposed between the corresponding pair of base plate mounting barrels 142 and 143, and locks the slide plate to the base plate with the threaded coupling pins fasteners 146. As described in the disclosure, low friction layers may be formed in many different materials, colors, sizes, and bottom configurations, and the design of the present embodiment allows the user to quickly and easily change slide plates at any time she may choose to do so. As specified above, the fasteners are preferably self locking screws, thereby reducing the likelihood that the vibrations and shocks experienced by the shoes during use will loosen and eventually eject the screws from the mounting tabs 134 and 142.

As disclosed previously, with the slide plate 130 securely mounted to the shoe a wearer may walk or run along a sidewalk, street or path at his or her chosen gait, and upon encountering an inviting curb, rail or the like may readily proceed with any one of a number of grinding activities. Because the design of the present embodiment places all grinding elements outside of the shoe interior, additional cushioning material may be placed over the insole to increase the user's comfort and safety during grinding maneuvers. In addition, because the slide plates arc relatively compact the user may conveniently carry one or more slide plates in a bag or even in a coat or pant pocket and interchange them as the grinding conditions encountered may warrant, thereby increasing the range of her grinding options and opportunities.

Figure 11:
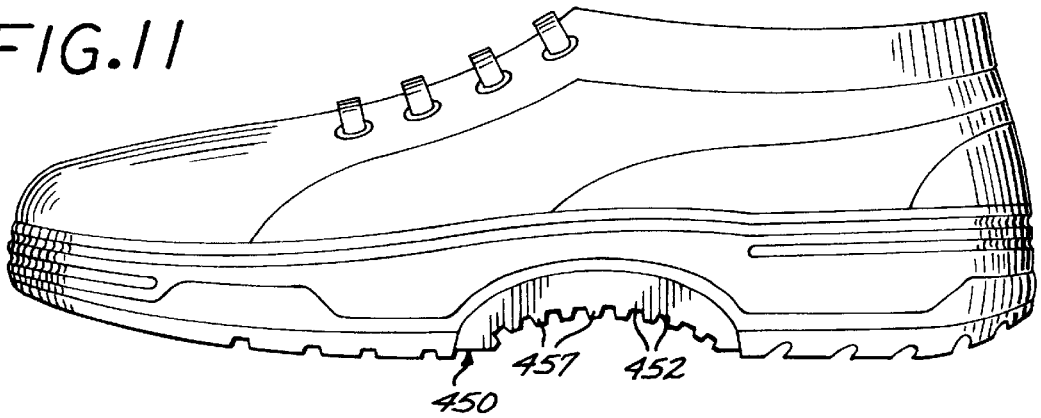
FIG. 11 is a side view of grinding footwear apparatus incorporating a fourth embodiment of the present invention.
Figure 12:
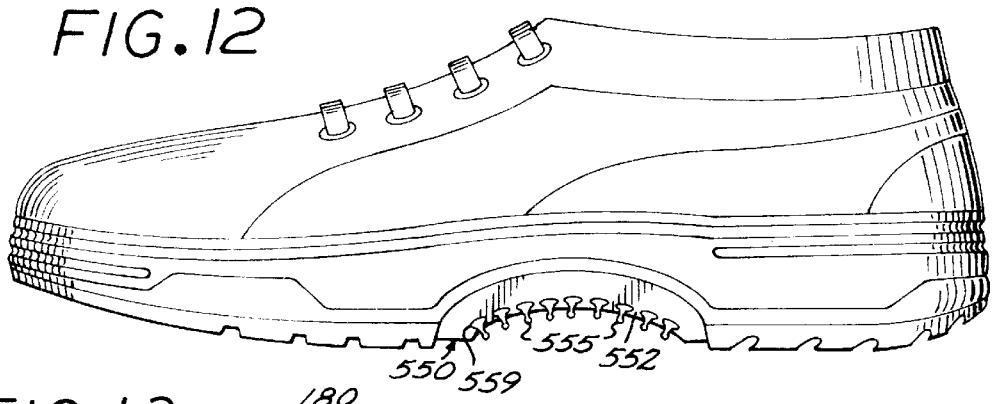
FIG. 12 is a side view of grinding footwear apparatus incorporating a fifth embodiment of the present invention.

In an alternative embodiment as depicted in FIG. 11, the slide plate of the present invention may be formed with a downward facing trough 452 configured with ribs 457 that offer reduced surface area to contact the supporting surface and thus act to minimize the level of frictional resistance encountered. Alternatively, as depicted in FIG. 12, the downward facing trough 552 may be formed with grooves 559 that receive and secure complementarily shaped, elongated sliding elements 555 which protrude from the surface of the slide plate 550 to form ribs that provide reduced sliding surface area and lower overall frictional resistance. The grooves 559 are formed with a substantially upper case omega-shaped (Ω) cross section comprising a narrow opening flanked by two ridges that cooperate to trap corresponding necks formed in the sliding elements 555 and prevent the sliding elements from being pulled out. Such elongated sliding elements 555 are easily replaced when worn down simply by being pushed out of their grooves 559, and thus preclude the necessity for a removable slide plate. In an alternative configuration, elongated sliding elements (not shown) may be received in complementary grooves formed directly in the sole of the shoe to cooperate in collectively defining a slide plate. To maintain the elongated sliding elements of this alternative design in fixed position while sliding along a supporting surface, and thereby prevent the sliding surface from forcing the sliding elements apart and contacting the underlying sole, the sole material in which the receiving grooves are formed must be of sufficient rigidity to withstand the shear forces imposed by the sliding motion. In either design, the ribs should be spaced about 3 mm apart. An additional advantage of using grooved slide plates is that footwear equipped with such sliding elements stops functioning as a grinding apparatus entirely when the sliding elements have been worn too far because in such circumstance the sliding surface comes into direct contact with the high friction sole of the shoe and thus precludes any possibility of sliding altogether. Footwear equipped with such elongated sliding elements therefore has a built-in warming mechanism for alerting the user to the need to replace the sliding elements.

Figure 13:
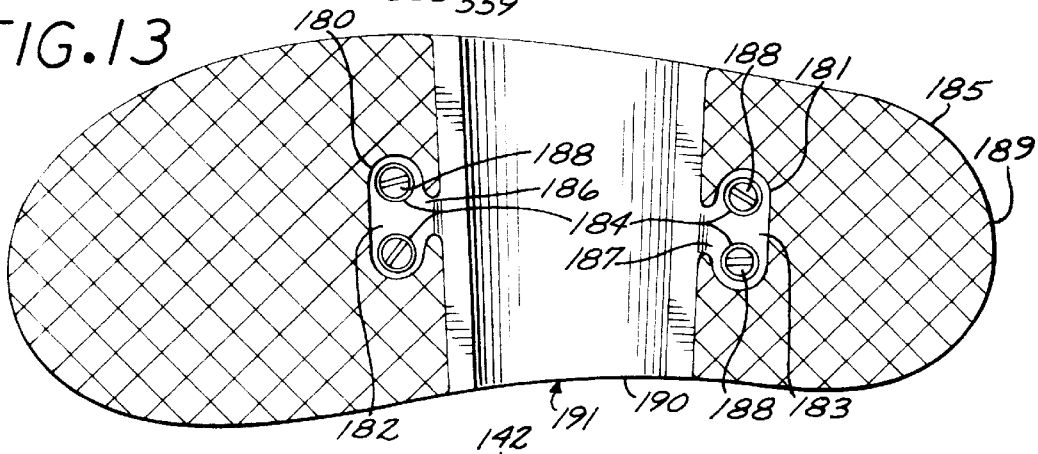
FIG. 13 is a bottom view of grinding footwear apparatus incorporating a sixth embodiment of the present invention.

Another embodiment of footwear apparatus incorporating the present invention is depicted in FIG. 13, where the sole 189 of a shoe is formed with a cavity 190 that extends laterally across the arch region of the sole and includes oval shaped centrally disposed anterior and posterior central tab pockets 180 and 181 configured with respective necked down stem-receiving channels. The slide plate, generally designated 191, of the present embodiment is formed with a body having an upper convex surface substantially conforming to the shape of the sole cavity 190, and is further configured with centrally disposed longitudinally projecting mounting tabs 182 and 183 carried from the front and the rear edge of the slide plate by respective stems 186 and 187. Such tabs include countersunk fastener bores 184. The slide plate 191 is mounted within the cavity 190, and the mounting tabs 182 and 183 and corresponding stems 186 and 187 are received in the complementarily shaped forward and aft tab pockets 180 and 181 and corresponding channels. Received in the bores 184 are fasteners 188 to secure the slide plate 191 within the cavity 190 by connecting to the sole 189 or to an overlying anchor plate as described previously.

The mounting tabs 182 and 183 of the slideplate 191 are of greater cross-section than the stems 186 and 187 and therefore when the mounting tabs are disposed within the corresponding cavity in the sole 189, the slide plate 191 is immobilized in place in a stable configuration that will not be disturbed by vibrations and shocks. Despite the added stability, the slide plate 130 of the present embodiment retains the ease of removal and replacement that characterizes the slide plate designs described elsewhere in the disclosure. The slide plate 191 may incorporate more than one mounting tab 182 or 183 attached to each edge, or alternatively may have one or more mounting tabs attached to only one edge. The stems 186 and 187 that attach the mounting tabs 182 and 183 to the slide plate 150 may be formed in a flexible configuration that expands and contracts to conform to the repeated elongation of the sole's bottom surface 185 caused by a walking or running gait.

Figure 14:
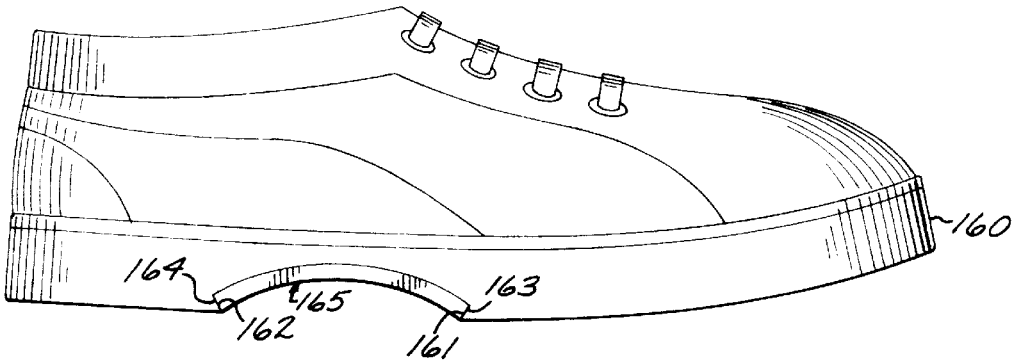
FIG. 14 is a side view of grinding footwear apparatus incorporating a seventh embodiment of the present invention.
Figure 15:
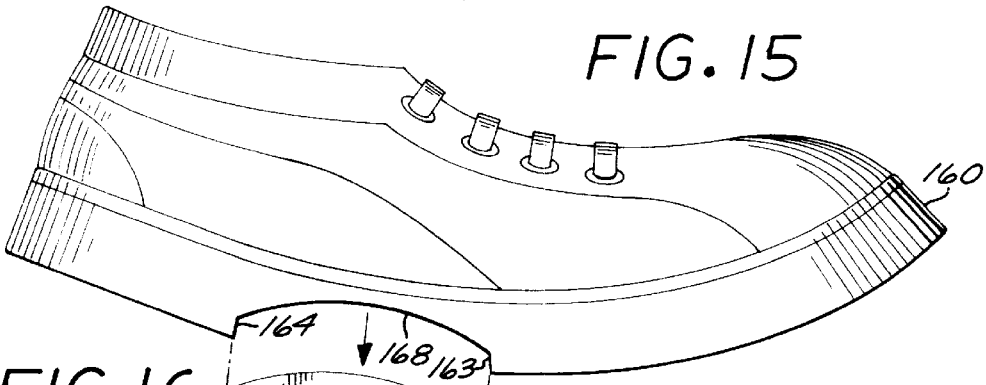
FIG. 15 is a partially exploded side view of the grinding footwear apparatus shown in FIG. 14.

Referring now to FIGS. 14 and 15, an alternative embodiment of the present invention employs a substantially rectangular in plan view, concave slide plate 165 received within a complementarily shaped cavity 168 formed in the bottom of a shoe sole 160. Such cavity is arcuately concave, projects laterally under the constrictable sole of the shoe, and terminates at its front and rear extremities with respective compressible vertical end walls 163 and 164. The front and rear edges 161 and 162 of the slide plate 165 are cut at a chamfer to, respectively, slope upwardly and forwardly and upwardly and rearwardly to be complementally received in the cavity 168 so that, in its normal unflexed position, the walls 163 and 164 will grip against the ends 161 and 162, respectively, of the plate to securely hold it in position. The slide plate is thus retained within the cavity by the friction fit between the respective front and rear edges of the slide plate and the cavity. The cavity 168 is sufficiently high in its sole 160 to ensure that the plate is recessed therein to and the relative longitudinal between such plate and cavity is such that the plate will be held grippingly therein to assure that in the normal flex applied to such shoe causing the toe or heel to bend upwardly, the length of the cavity will not be stretched lengthwise sufficiently to align the walls 163 and 164 to release the respective edges 161 and 162. To remove the slide plate, the user may simply flex the sole in an extreme convex configuration ending the toe and heel upwardly until the edges of the cavity defined by the walls 163 and 164 disengage the ends 161 and 162 of the plate.

This embodiment of a shoe for grinding provides a single element to enable the user to slide along a supporting surface, and employs no mechanical or adhesive fasteners. The resulting shoe is thus lightweight and comfortable, and the user does not need to carry tools of any kind to be able to exchange slide plates at any time she so desires. The uncomplicated nature of this embodiment also carries over into manufacturing advantages because the simple design of the slide plate and the sole lend themselves to easy implementation through a variety of manufacturing processes, including extrusion molding, stamping, and machining.

Although the preceding embodiments have been described in terms of sliding surfaces or elements formed or adapted to shoes, it will be appreciated by those skilled in the art that the apparatus of the present invention is equally adaptable to any and all types of footwear. Sliding surfaces can thus be formed in, and sliding elements adapted to, sandals, boots, shoes, slippers, socks, skates, and any other device or article of wear that is meant to be attached to the human foot. For purposes of illustration, as depicted in FIG. 16, an embodiment of the present invention may also take the form of a device incorporating low friction sliding surfaces and adapted for attachment over an article of footwear or a user's otherwise unshod foot.

Figure 16:
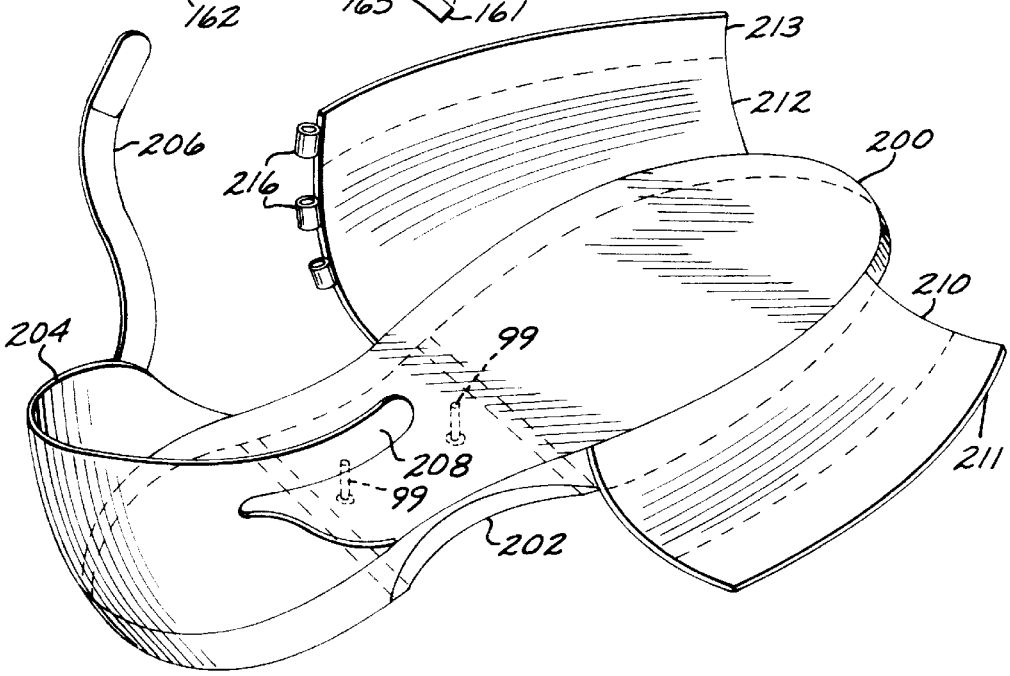
FIG. 16 is a perspective view of grinding footwear apparatus incorporating an eighth embodiment of the present invention.

The grinding sandal shown in FIG. 16 includes a cushioning sole 200 formed with a medial contoured downwardly opening recess removably receiving a low friction sliding plate 202. The sliding plate may be formed in any configuration, including those configurations disclosed previously in the specification, and may be secured to the sole in any manner previously disclosed, or by inserting threaded fasteners 99 as shown. The sole 200 may be formed from an elastic material that will conform to the article of footwear it is encasing and thus accommodate a walking or running gait, or alternatively may be formed from a stiff material that will offer enhanced support during grinding maneuvers.

The sandal includes two laterally disposed instep flaps 210 and 212 extending upward from the upper left and right edges of the sole into overlying relationship of the free marginal edges. The free margins are equipped with fasteners 211 and 213 such as complementary hook and loop fasteners, laces, or zippers that cooperate to securely fasten the two flaps together. The flaps may leave the toe region open or may extend all the way around the front of the sole, and may be constructed from solid sheets of material or may have perforations of any desired shape and size formed therein for improved air circulation and aesthetic appeal. The materials used in constructing the flaps must offer sufficient tensile strength to withstand the rigors imposed by grinding maneuvers, and may include plastic, cloth, leather, and rubber. A semi-cylindrical heel cup 204 rises upwardly from the periphery of the heel, and has connected to the opposite sides thereof two thin straps 206 and 208 with mounting fasteners disposed on their free extremities, such as complementary hook and loop fasteners. Either one of the front flaps 210 or 212 is equipped with open ended, cylindrical lengths of tubing 216 attached to and axially parallel with the rear edge of the flap, and sized to receive either one of the thin straps.

In operation, the present embodiment is positioned with its sole 200 disposed beneath the sole of the article of footwear being worn by the user, or beneath the user's unshod foot, and the two flaps 210 and 212 are then fastened together snugly over the user's forefoot region. The thin straps 206 or 208 are next wrapped around the user's foot adjacent to the ankle region, one strap is threaded through the lengths of tubing 216 bonded to the rear edge of either flap, and the two straps are then fastened together securely around the user's foot. In this manner the apparatus of the present embodiment is securely fastened around the user's article of footwear or unshod foot in the forefoot region as well as the heel region, and the two regions are held in tension relative to one another by the thin straps pulling back on the flap through the lengths of tubing, thereby enhancing the level of support and stability experienced by the user while engaging in a grin ding maneuver. It will thus be appreciated that the present embodiment as described enables persons to engage in grinding activities even when they cannot wear footwear equipped with sliding surfaces, such as due to the work place code of dress or safety requirements, by providing a conveniently sized shoe apparatus that can be easily stored and carried around in a small space, and can be quickly deployed and ready for use with a minimum of effort and time expended.

Figure 17:
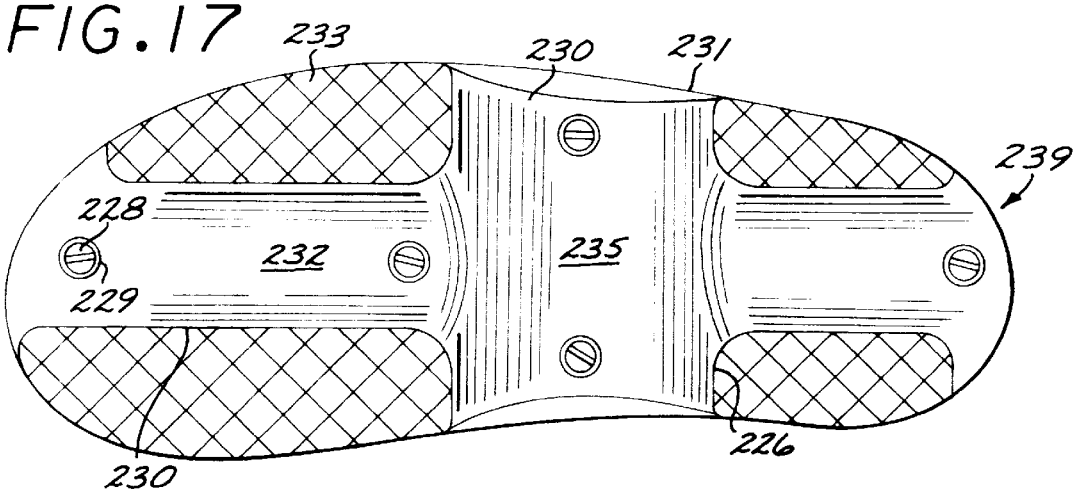
FIG. 17 shows a bottom plan view of a grinding shoe device incorporating a ninth embodiment of the present invention.

The embodiments disclosed previously include concaved sliding surfaces that extend laterally across the sole of the particular article of footwear. However, it will be understood by those skilled in the art that there is no limitation upon the configuration of the sliding surface other than those imposed by the requirements of grinding. The shape of the sliding surface may thus be so as to traverse the sole of the shoe latitudinally or longitudinally or, as illustrated in FIG. 17, both latitudinally and longitudinally. The grinding shoe apparatus depicted in FIG. 17, includes, generally, a shoe incorporating a flexible sole having a downwardly facing forefoot and rear foot tread surface 233 configured centrally with a longitudinally extending, downwardly opening recess 230 which in this instance projects from the forward to the rearward extent of the shoe. This embodiment also incorporates a transverse downwardly opening recess 226. A grind plate device, generally designated 239, is provided and is formed on its top side to complementally fit the contour of the respective longitudinal and transverse recess sections 230 and 226. The grind plate device 239 is configured with a transverse grind plate section 235 complementally received in the recess 226 and a longitudinal grind plate section 232 complementally received in the longitudinal recess 230. At least the longitudinal grind plate section 232 is configured to incorporate some flexibility along the length thereof to flex at least to some degree with the sole of the shoe to facilitate running and walking by the wearer. In the configuration shown, both the longitudinal and transverse plate sections 232 and 235 are formed with downwardly facing arcuate-in-cross section troughs which may be centered over a rail or the like to operate in maintaining the shoe centered on the rail on which such device is sliding.

A shoe thus equipped allows the user the choice of sliding along a supporting protuberance facing sideways or facing forward. Alternatively, the user may engage one foot in a sideways stance and the other foot in a forward facing stance, thus placing herself in a stable position that allows switching to other positions conveniently without interruption of the sliding motion. It will be understood that a shoe that allows sliding while facing forward will also allow sliding while facing rearward.

It will be appreciated by those skilled in the art that the sole 233 is typically in the form of an athletic shoe sole which is typically highly flexible, formed with a downwardly facing tread surface which may be roughened with a tread pattern of any desired shape or may even be smooth to form a smooth tread pattern. This tread surface engages the ground during a normal gait cycle. The athletic shoe sole typically incorporates cushioning to cushion the shock applied to the bottom surface thereof during running and jumping maneuvers.

As disclosed in our earlier patent applications, U.S. Ser. No. 08/799,062, filed Feb. 10, 1997, and its continuation-in-part application, U.S. Ser. No. 08/890,595, now U.S. Pat. Nos. 5,970,631 and 6,006,451, respectively, the transverse recess 226 in the sole 233 may be arcuate in both longitudinal and transverse cross-section and may be curved upwardly on the opposite lateral sides of the sole to form somewhat of a saddle shape and the transverse arch grind plate 235 may be complementally contoured on its top side for nesting thereinto. The transverse arch plate 235 may be formed on its laterally outwardly facing sides with upwardly and outwardly sloped grind rails 231 which may serve to grind along the support rail or the like when the shoe is tilted to one side or the other.

Still referring to FIG. 17, the longitudinal grind plate section 232 may extend from the tip end of the heel to the tip end of the toe and is preferably received in an elongated longitudinal recess which is likewise curved in transverse cross-section for nesting therein of the complementally shaped top side of such grind plate section 232. The longitudinal grind plate 232 may be flared laterally outwardly at both the heel and toe sections to form an increased laterally extending surface for grinding thereof when the shoe is tipped up on either the toe end or the heel end to result in grinding along on the peripheral grind surface. The grind plate 239 may be molded in the shoe sole 233 or may be bonded thereto or fastened thereto in any other convenient manner, such as by fastener screws 228 received in countersunk bore holes 229 to be countersunk upwardly below the lowermost surface of the respective arcuate in cross-section longitudinal and transverse grind troughs defined in the longitudinal and transverse grind plate sections 232 and 235, respectively.

For certain grind maneuvers, it may be desirable that the transverse grind section be shifted forwardly or rearwardly firm the arch area and that the longitudinal grind plate section be shifted to one side or the other of the longitudinal central axis of the foot and possibly angled to angle forwardly or rearwardly from the transverse grind plate section and angling to one side or the other of the heel or toe. As an example, the shoe sole 233', shown in FIG. 18, incorporates a transverse downwardly opening recess in the arch area comparable to that for the sole 233 shown in FIG. 17 and incorporates a longitudinal recess section which is, like the longitudinal recess section shown in FIG. 17, curved in transverse cross-section. This variation of the cross-shaped slide plate disclosed above also includes a slide plate 236 whose longitudinal sliding surface 234 is formed diagonally across the shoe sole 233' and extends from the big toe region to the outer heel region and intersects the latitudinal sliding surface 230' in the arch region of the sole to create a somewhat diagonally extending trough for receipt of an underlying support rail so the user can grind along such rail with his or her toe angled forwardly and somewhat outwardly relative to the longitudinal axis of the rail. Alternatively, the longitudinal sliding surface may extend from the outer toe region to the inner heel region. These variations differ in the amount of ankle twist experienced by the user while employing the switch stance described above, and thus allow users to select the configuration best suited to their physiological needs as well as their intended application.

Figure 18:
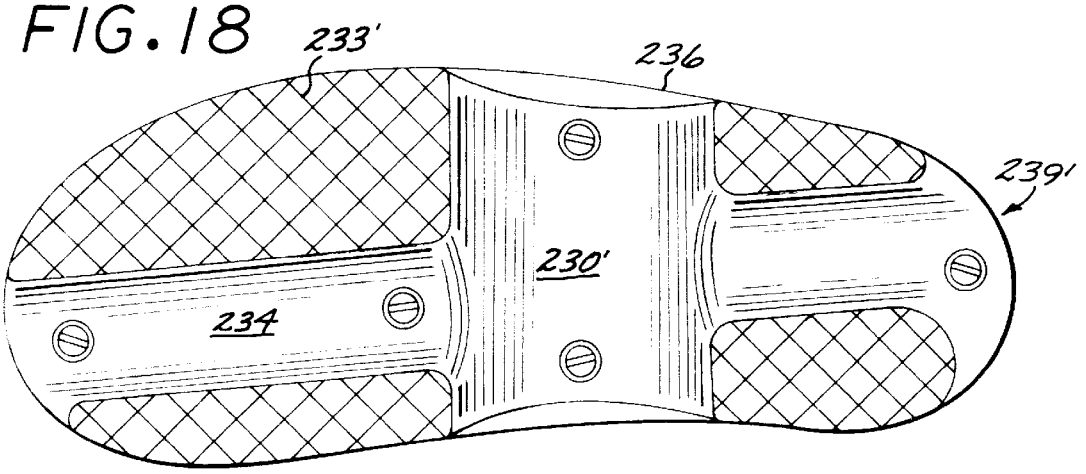
FIG. 18 is a bottom plan view of a modification of the grinding shoe device shown in FIG. 17.

It will be appreciated that at least the longitudinal grind plate sections 232 and 234 of the grind plates 239 and 239', shown in FIGS. 17 and 18, respectively, may be constructed of relatively thin plastic, such as Supertuf 810 Nylon available from Dupont, for instance, on the order of about 0.10 inches thick so that the longitudinal grind plate section will have some longitudinal flexibility to thus flex somewhat with the flexing of the shoe sole 233 or 233' to thus facilitate walking and running by the user wearing such shoe. Other materials that may be found to be acceptable include other forms of nylon, such as Nylon 6, Nylon 66, plastics such as PTEX, TPU, hard rubbers, glass, ceramics, metals, polyethylene and composites.

Figure 19:
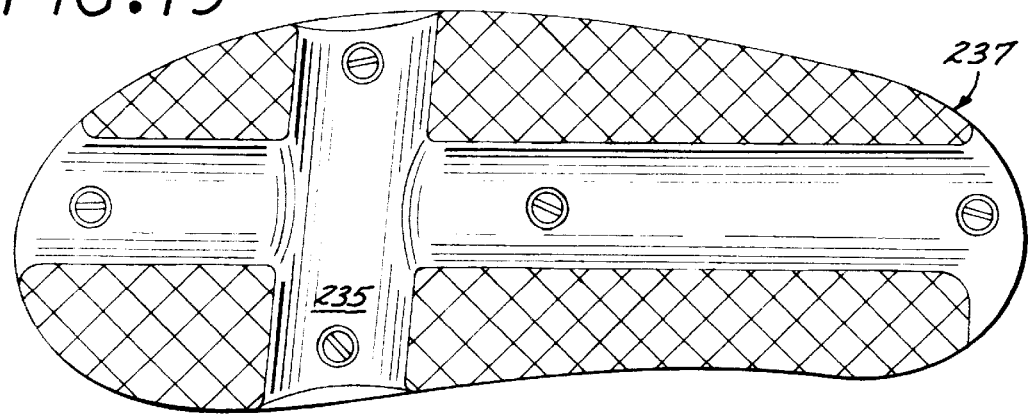
FIG. 19 is a bottom plan view of a further modification of the grinding shoe apparatus shown in FIG. 17.

Another embodiment of a cross-shaped slide plate according to the present invention is illustrated in FIG. 19, wherein the slide plate, generally designated 237 is formed with a latitudinal sliding surface 235 that extends across the ball, as opposed to the arch, of the foot. This configuration allows the user to support her weight during a sideways grinding maneuver with the ball of her foot and thus reduce considerably the stress experienced by the arch of her foot. This is an important consideration for a large segment of the population that suffers from misformed arches as well as other foot ailments.

In operation, it will be appreciated by those skilled in the art that the grinding shoe apparatus shown in FIGS. 17 through 19 may be worn by a user going about everyday activities, Such as attending school or, for instance, traveling to and from a basketball or other activities court. Worn in the normal manner, the user may go about his or her normal activity, walking or running in the normal fashion on normal support surfaces Such as sidewalks, asphalt and tile under surface. With the grind plate devices recessed upwardly in the recesses above the respective tread surfaces of the respective soles, the user is not inhibited from normal shoe use.

Upon coming across an object worthy of sliding over, such as a pipe rails, curbs, or similar object, the user may direct the slide plate of choice, either the longitudinal plate or the transverse plate, onto to the rigid support surface and slide therealong in a direction determined by the projection of the plate. More athletic wearers may transition from one plate to the other by slightly hopping off the rail and turning the feet to align the alternate plate on the rail and continue sliding.

Figure 20:
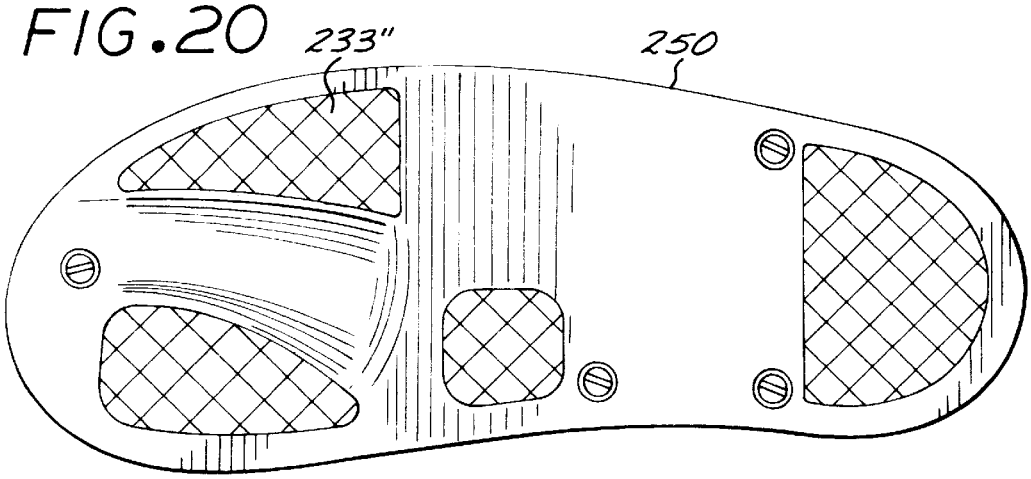
FIG. 20 is a bottom plan view of a tenth embodiment of the grind shoe apparatus of the present invention.

FIG. 20 illustrates an embodiment that maximizes the sliding area of the shoe sole while providing the minimum amount of high friction surface 233" necessary for supporting the foot and engaging the ground during a sustained walking or running gait. Protruding high friction, ground engaging areas 233" are thus provided in the heel, ball, and toe regions of the foot, and the remainder of the sole's bottom is covered by a recessed, low friction slide plate 250. This con figuration permits the user to orient her feet in a variety of directions while sliding across a supporting surface, and also allows her to rotate across the supporting surface while sliding along it, executing in essence a sliding pirouette. This ability bestows upon the user significantly enhanced flexibility and increases her level of enjoyment as well as her safety by allowing rapid switching to whatever stance is most appropriate for each section of a non-uniform sliding surface.

Figure 21:
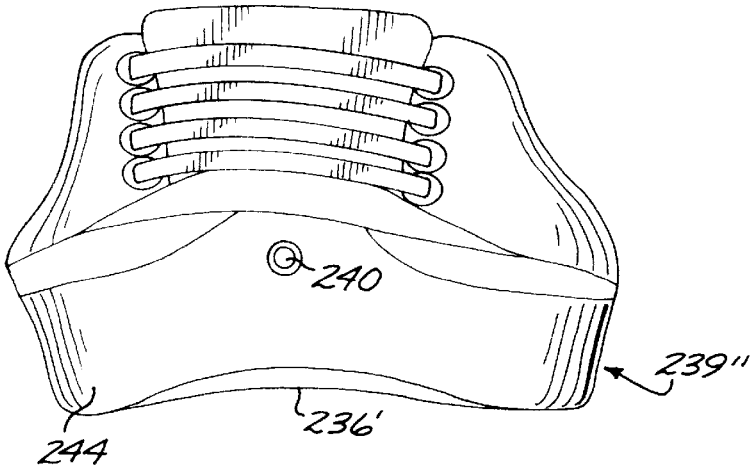
FIGS. 21 and 22 are front and rear views, respectively, of the grinding shoe apparatus shown in FIG. 17.
Figure 22:
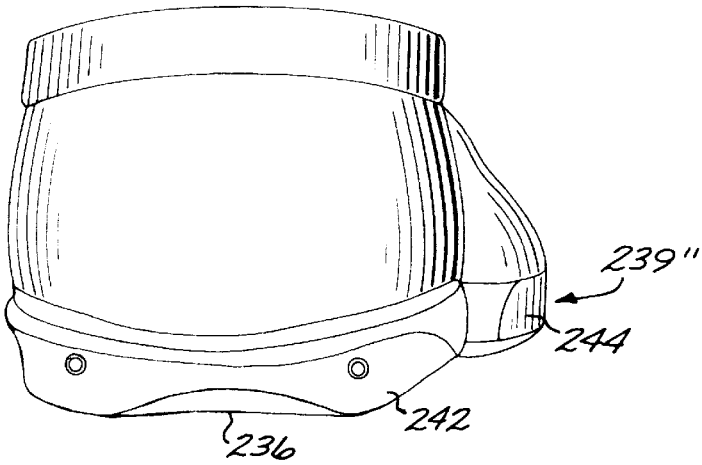

It is very important to note that the present invention is not limited to providing sliding surfaces on the bottom side of the sole of an article of footwear. Low friction sliding surfaces may also be formed on the sides of the sole, as illustrated in FIGS. 21 and 22 where a shoe apparatus having a recessed slide plate 236' in the bottom of its sole 239" also includes low friction slide elements attached along the side walls of the sole. The embodiment as illustrated includes a lateral slide element 244 attached around the perimeter of the toe region of the sole and a lateral slide element 242 attached around the perimeter of the heel region of the sole. Alternatively, the toe and heel lateral slide elements 244 and 242 may be formed as one single continuous element that overlies the side walls of the entire shoe sole 239".

Lateral sliding elements must retain the interchangeable nature of the bottom sliding elements disclosed previously, and therefore must be fastened in a secure but removable manner to the side walls of the shoe sole 239". The preferred fastening method employs threaded fasteners 240 that pass through bores formed in the lateral sliding elements 242 and 244 and threadingly engage the inner threads of inserts mounted within the side walls of the sole. The bores in the lateral sliding elements are preferably countersunk to accept the heads of the fasteners therein and protect them from coming into contact with the supporting surface. The heads of the fasteners may be formed with cavity to permit rotational engagement of the fasteners with tools such as hex wrenches or screwdrivers, and may also be formed with the trade name or logo of the manufacturer. If the aesthetics of the fastener head are not appealing to the users, opaque plugs that fit into the recess and cover the head may be used. The plugs must also be recessed from the supporting surface to prevent abrasive damage, and may also be formed with trademarks and logos upon their exposed side. As previously described, self locking fasteners such as Nylock® are preferred for use in this application.

An alternative fastening method employs hooked tabs formed on the inner side of the lateral sliding elements 242 and 244 that lockingly engage complementary shaped receiving chambers formed in the side walls of the shoe sole 239". The tabs must be sufficiently flexible to bend as the lateral sliding element is forced against the side wall of the sole during installation, but must also have sufficient mechanical strength to withstand the forces exerted upon it over the expected lifetime of the sliding element. When the sliding element must be removed, a screwdriver or similar object is inserted between the sliding element inner surface and the side wall of the sole and the hooked tabs are pried out of the receiving chambers.

The configuration for a grinding shoe described above allows the user to slide along a multi-sided supporting surface such as a V-shaped groove by engaging both the bottom and the lateral sliding surfaces of her shoe, and also allows further creative freedom in developing new grinding maneuvers such as sliding along the toes or the heels. Furthermore, lateral sliding surfaces also permit the user to slide along flat supporting surfaces such as sidewalks, thus obviating the need for a protrusion in the supporting surface and greatly expanding the range of grinding possibilities to practically any surface of sufficient stiffness and strength.

Figure 23:
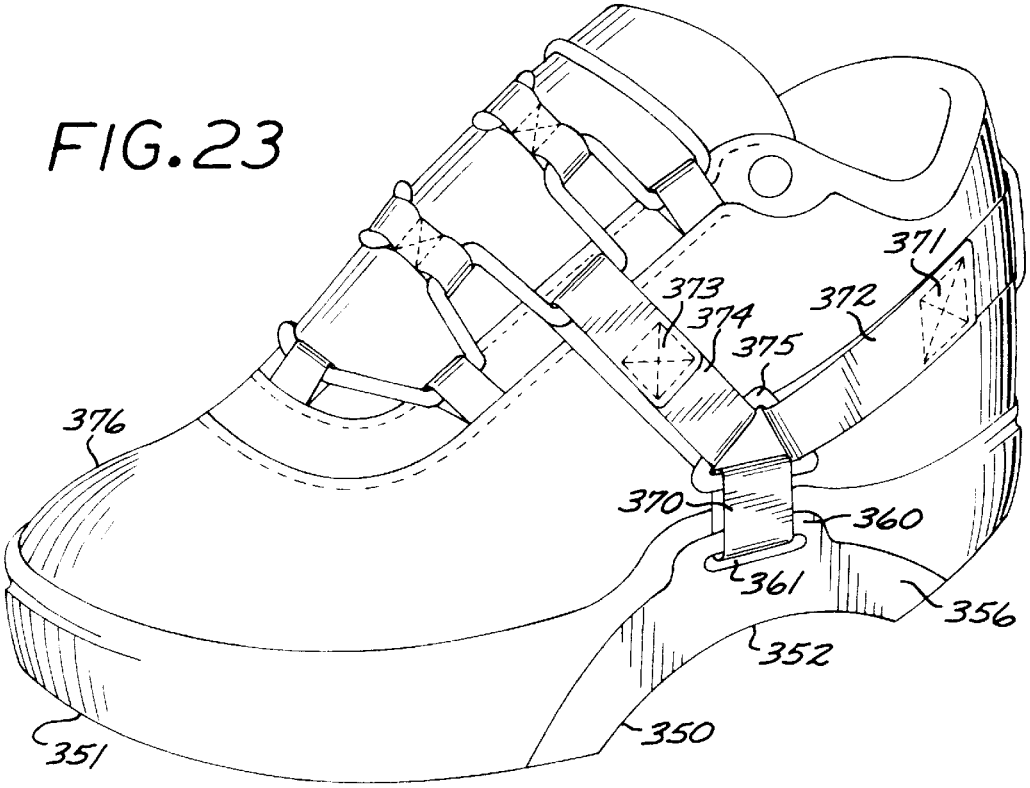
FIG. 23 is a perspective view of grinding footwear apparatus incorporating an eleventh embodiment of the present invention.

All of the foregoing embodiments include removable slide plates, but require some rudimentary tools, whether a screwdriver, a knife, or a coin, to disengage the respective fasteners and remove the slide plate. It is foreseeable that the need may arise for a slide plate design employing a fastening system that requires absolutely no tools for removal and replacement, and is even quicker and easier to operate. One such alternative fastening system is shown in FIG. 23, wherein a shoe has an upper 376 attached to a sole 351 formed with a downward facing cavity in the arch region and receiving a slide plate 350 therein. The slide plate has a downward facing, concaved, substantially semi-cylindrical low friction trough 352 and is formed with laterally disposed upturned flanges 356. The flanges include a centrally disposed, upwardly facing tab 360 with a horizontal slot 361 therethrough.

A loop of webbing 370 passes through each slot 361 and through a triangular member 375 held in tension above each tab. 360 A strap 374 equipped with hook-and-loop fasteners 373 also passes through each triangular member 375 and engages the laces on either side of the shoe. One heel strap 372 equipped with hook and loop enclosures 371 passes through both triangular members and around the rear of the shoe. In this manner each triangular member 375 receives three straps 370, 372 and 374, each of which engages one side of the member.

In operation, the user may select a slide plate 350 with the desired characteristics and which has webbing loops 370 and triangular members 375 permanently, or alternatively removably, attached thereto. The user may then place the slide plate 350 in the cavity of the sole 351, loop a strap 374 through each triangular member 375 and the laces of the shoe, loop a heel strap 372 through each member and around the rear of the shoe, then adjust the tension in the three straps and engage their hook-and-loop fasteners to secure the slide plate within the sole cavity. It will be appreciated that this design allows very rapid removal, and almost equally rapid installation, of the slide plate 350. This feature may be extremely useful in circumstances where the user cannot or may not wear footwear for grinding. In addition, the need for any tools to remove the slide plate is eliminated, greatly enhancing the convenience of using the slide plates of the present invention.

Figure 24:
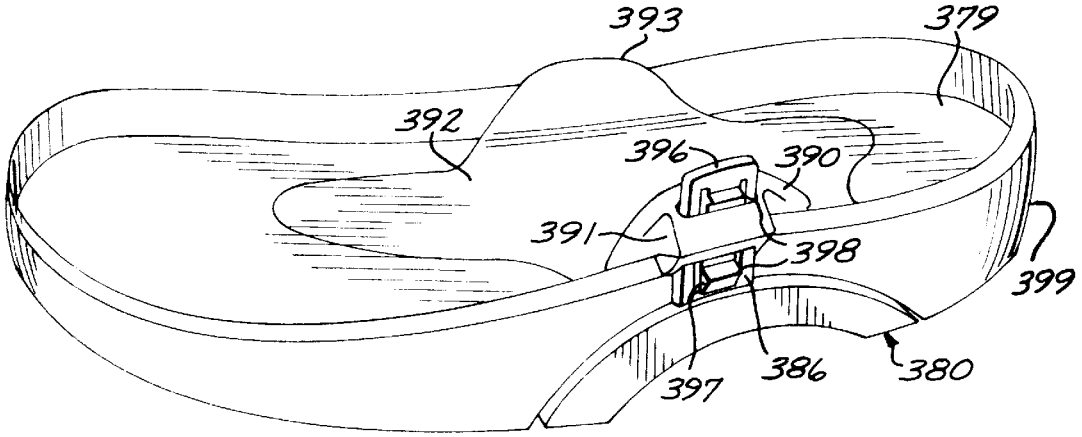
FIG. 24 is a perspective view of a sole for grinding shoe apparatus incorporating a twelfth embodiment of the present invention.

In an alternative embodiment having one of a variety of potential quick release mechanisms, a quick release slide plate, as shown in FIG. 24, the cup 379 of the sole 399 receives an overlying mount anchor plate 392 formed with laterally disposed, upturned flanges 393 that rise above the upper edge of the sole and are exterior to the upper of the shoe. A mount 390 is formed on the upper end of each flange 393 and includes a bridge 391 that defines an upright slot with an inner serration. The slide plate 380 of the present embodiment is formed with tabs 396 extending upwardly from laterally disposed upturned flanges 386. Each tab 396 is formed with an inner rectangular opening and a tongue 397 maintained within the opening and flexibly connected to the tab at one end of the opening. The tongues 397 are configured with outwardly facing teeth 398 sized to engage the inner serration of the mounts 390.

In operation the user may insert the tabs 396 of the slide plate 380 through the corresponding mount 390 until the slide plate is fully received within the cavity of the shoe sole 399. As the tongue teeth 398 pass by the inner serrations of the mounts 390 a click sound is emitted, thereby assuring the user that the slide plate 380 is properly inserted and secured to the shoe. The use of an anchor plate 392 to secure the mounts 390 to the shoe is beneficial because the need to secure the mounts to the upper of the shoe is avoided, thereby preventing undue stress and premature damage to the shoe upper. The slide plate of the present embodiment is very easily attached to the shoe, and once the upper end of each tab 396 has been inserted into the corresponding mount 390, the user may simply step down on the shoe and force the shoe to slide down onto the slide plate. Once inserted to their furthest extent, the tongues 397 are secured within the mounts 390 by the inner serrations which engage and secure the tongue teeth 398. To remove the slide plate 380, the user will push in the free end of each tongue 397 with the fingers of one hand and then pull the slide plate down and away from the sole 399. The design of the present embodiment therefore allows the user to insert and remove each slide plate with one hand in a single, quick motion. Another benefit afforded by the present design manifests itself in the form of additional lateral support provided by the upturned flanges 393 of the mount anchor plate 392, which reach past the top of the sole 399 and thereby provide a saddle for the receipt and support of the users foot therebetween.

Figure 25:
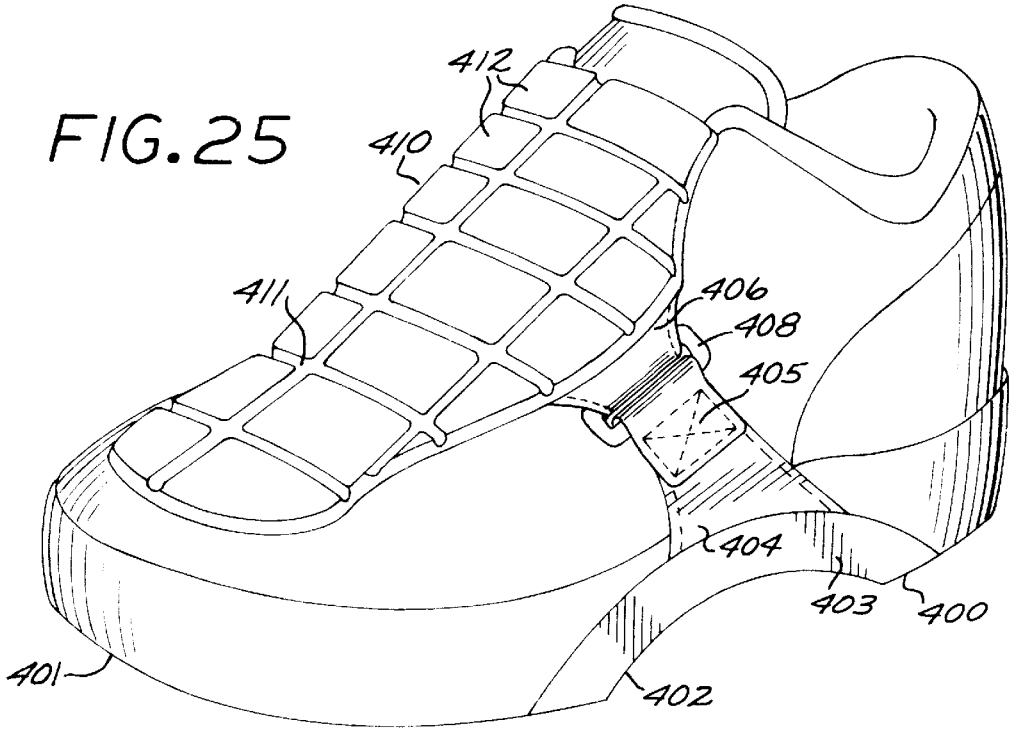
FIG. 25 is a perspective view of grinding footwear apparatus incorporating a thirteenth embodiment of the present invention.

It must be appreciated that the practice of the present invention need not be limited solely to slide plates mounted to the sides and bottom of footwear, but may be equally adaptable to the tipper of a shoe. As illustrated in FIG. 25, an alternative embodiment of a shoe according to the present invention includes an upper attached to a sole 401 formed with a cavity receiving a slide plate 400 therein. The slide plate is formed with a downward facing, substantially semicylindrical, concaved, low friction trough 402 and laterally disposed, upturned flanges 403. Attached to each flange 403 is a strap 404 equipped with hook and loop fasteners 405. An instep slide plate 410 shaped to conform substantially to the instep surface of the upper is located over the instep of the shoe. The instep slide plate 410 is formed with an tipper surface configured with low friction, flat surfaced protrusions 412 overlying a flexible substrate 411. A loop of webbing 406 is attached to each side of the instep slide plate 410 and passes through a D-ring 408.

In practice, the user will select a slide plate 400 and an instep slide plate 410, then mount them to her shoe by placing the slide plate within the sole cavity and the instep slide plate over the instep area of the shoe, then looping the slide plate straps 404 through the D-rings 408 and fastening the straps with the hook and loop fasteners 405 to tightly secure the two slide plates to the shoe. The addition of the instep slide plate 410 does not interfere with the user's normal gait because the flexible substrate 411 of the plate flexes in a concave configuration with each step of the user. When desiring to engage in grinding activities, the user may perform all grinding maneuvers described and alluded to previously, as well as novel maneuvers enabled by the addition of sliding surfaces to the upper of the shoe. For instance, the user may engage a pipe rail with the slide plate 400 of the leading shoe and the instep slide plate 410 of the trailing shoe by bending her trailing knee to or below the level of the pipe rail. The stance may be reversed, where the instep slide plate 410 leads and the slide plate 400 trails. Alternatively, the user may ride two rails simultaneously by engaging one rail with the slide plate 400 of one shoe and the other rail with the instep slide plate 410 of the other shoe and assuming a sideways stance between the two rails. As evidenced by the foregoing, the provision of an instep slide plate raises the level of athletic enjoyment of the user and expands the range of possible maneuvers.

Figure 26:
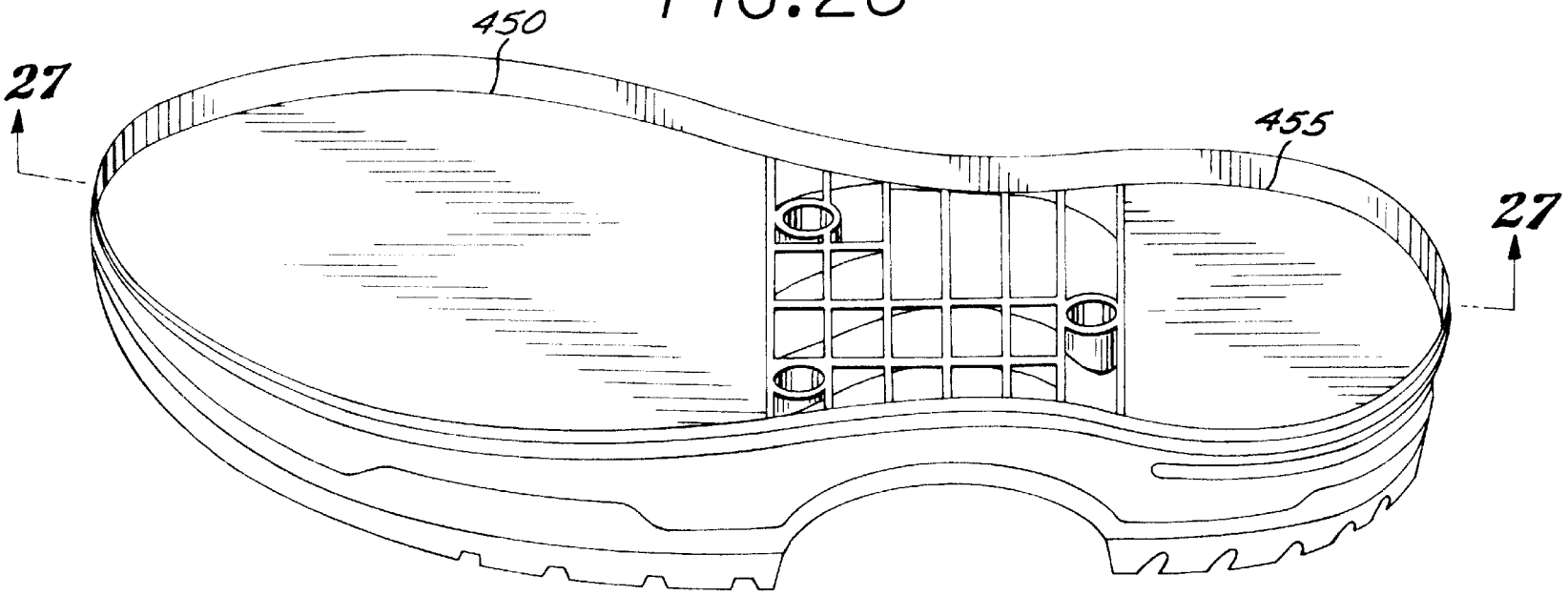
FIG. 26 is a perspective view of a shoe sole incorporated in a further embodiment of the present invention.
Figure 27:
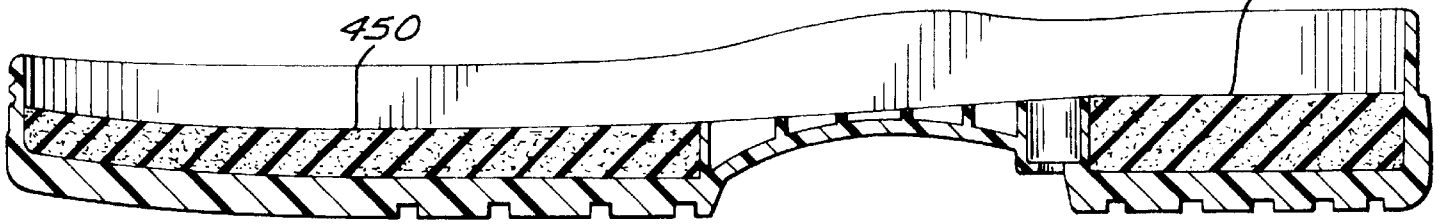
FIG. 27 is a longitudinal sectional view of the shoe sole shown in FIG. 26.

Referring to the shoe shown in FIGS. 26 and 27, a further embodiment of the grinding shoe of the present invention includes a shoe sole, generally designated 449, configured at the posterior extremity with an upwardly opening generally semi-cylindrically shaped heel pocket 451 and at its forward extremity with an upwardly opening forefoot pocket 453. Received in the respective pockets 451 and 453 are respective complementally shaped shock absorption insert pads 450 and 455 which may be of closed foam construction for efficient absorption of impact forces. The sole 449 is formed medially with a gridwork, generally designated 459, to afford lightweight structural support in the arch area. Consequently, in use a slide plate may be secured to the underside of the sole 449, with the upper attached to such sole, the user can perform grinding activities. It will be appreciated that an insole will typically overlie the cushion inserts 450 and 455 and that, from a dynamic landing force, the inserts will serve to absorb certain of such forces thus minimizing any tendency for injury of the bone structure in the foot of the user.

It will be appreciated by those skilled in the art that the present invention is not limited to providing sliding elements that are removably attached to articles of footwear. Any method may be used to provide an article of footwear with low friction surfaces, and may include forming the sliding surfaces integral to the sole during the extrusion molding process, or alternatively may consist of sintering low friction material into certain regions of the sole. The use of such permanent, non-removable sliding surfaces is highly dependent upon the ready availability of materials of sufficient durability to withstand repeated sliding across abrasive surfaces for the expected lifetime of the article of footwear. Such materials tend to be difficult to process and costly, and it is for this reason that the preferred embodiments disclosed herein include removable slide elements.

It will be appreciated that the cruciform embodiments discussed above facilitate a variety of foot positions to maintain while grinding and the use of thin longitudinal plate sections allows some flexibility. However, there often arises the need for greater flexibility along the length of the grind plate to facilitate the degree of flexion achievable by the wearers' foot and to accommodate variably inclined support surfaces. Through incorporation of independently moveable longitudinal plate sections, the degree of flexibility is increased to the satisfaction of many athletes.

Figure 28:
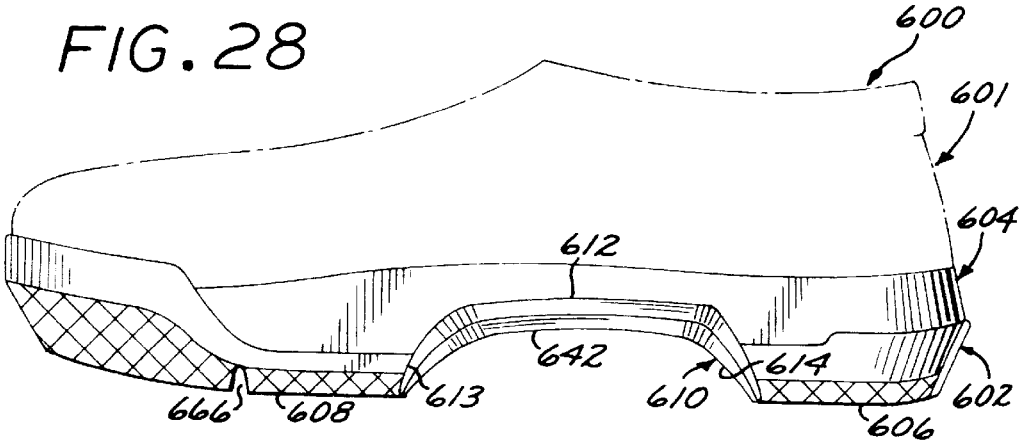
FIG. 28 is a medial side view of a fourteenth embodiment of the grinding shoe apparatus of the present invention.
Figure 29:
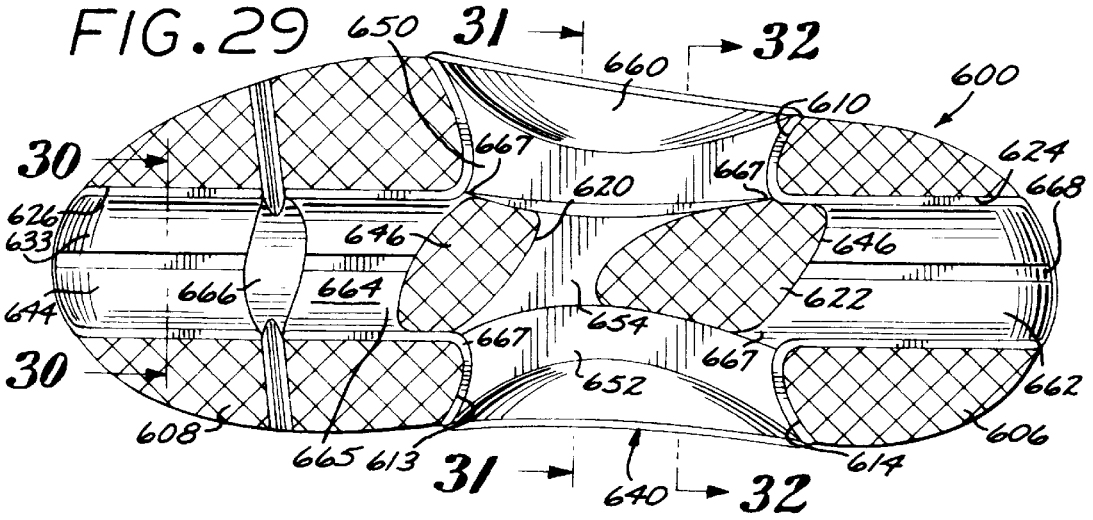
FIG. 29 is a bottom plan view of the grinding shoe apparatus shown in FIG. 28.
Figure 30:
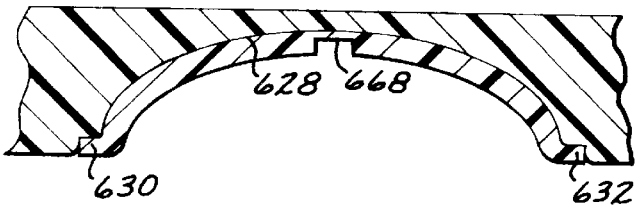
FIG. 30 is a transverse sectional view, in enlarged scale, taken along the line 30—30 of FIG. 29.

Such a grinding shoe apparatus is shown in FIG. 28 which includes an athletic shoe, generally designated 600, having an upper 601 shown in phantom lines, mounted on an outsole 602 with a midsole 604 interposed therebetween. The midsole 604 and outsole 602 cooperate to form a downwardly facing tread surface having a heel portion 606 and a forefoot portion 608, Such tread portions being separated by an elongated upwardly raised recess 610 interposed therebetween and formed with a contoured top wall 612 and downwardly inclined front and rear walls 613 and 614, respectively. Referring to FIG. 29, the arch recess 610 curves upwardly and outwardly on the opposite sides and is formed centrally with downwardly projecting contoured tread patches 620 and 622. The sole 602 is further formed with longitudinally projecting recess sections 624 and 626 disposed in the respective heel and toe portions 606 and 608, such sections 624 and 626 having a generally arcuate transverse top wall 628 (FIG. 30) and being formed on its opposite sides with laterally outwardly extending, downwardly facing notches 630 and 632 (FIG. 30). Each section of the longitudinally projecting recesses, tunnels, or channels lies substantially in a horizontal plane above the horizontal plane formed by the tread surface.

Figure 31:
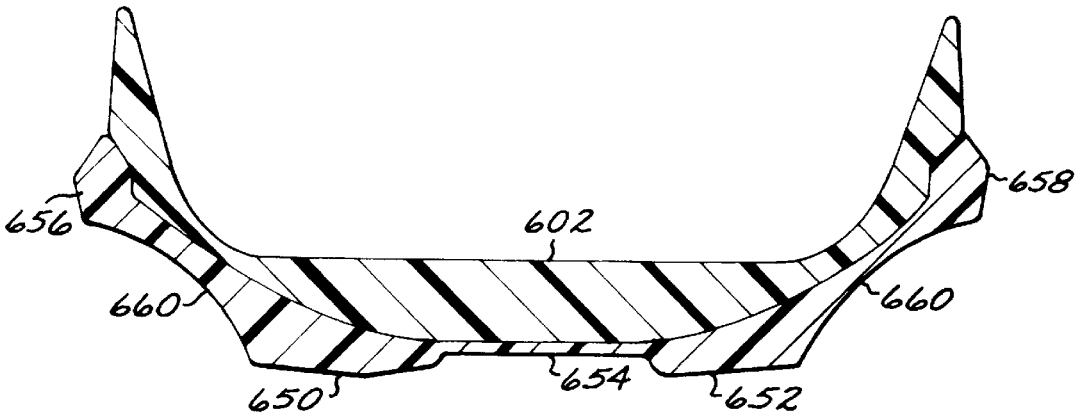
FIGS. 31 and 32 are transverse sectional views, in enlarged scale, taken along the respective lines 31—31 and 32—32 of FIG. 30.
Figure 32:
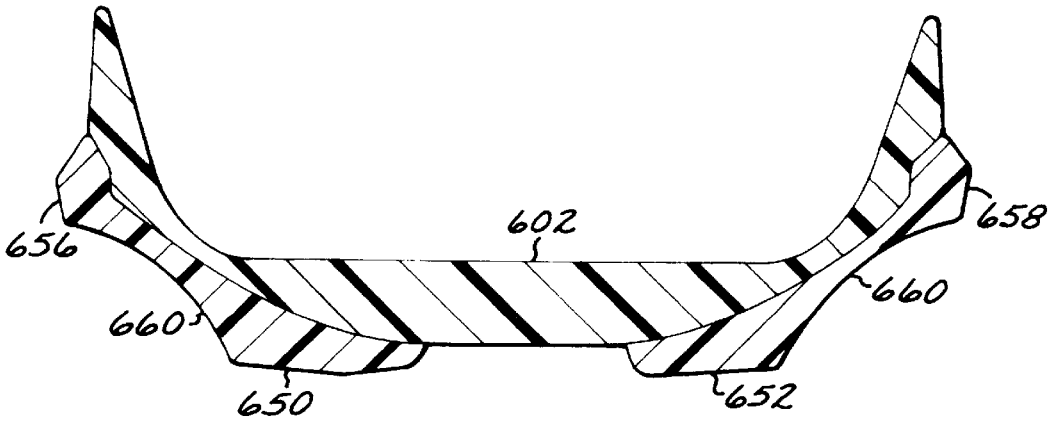

The grinding shoe apparatus further incorporates a sliding plate, generally designated 640, formed with an upper surface configured to complementally engage such lateral and longitudinal recesses and a lower surface constructed for sliding engagement with a variety of support surfaces such as a rail or the like. The plate is typically positioned in the respective recesses and bonded or mechanically fastened to the sole of the shoe such that the plate does not extend below the lowermost extend of the tread surfaces so as not to interfere with normal walking and running activities. The sliding plate 640 is of a general cruciform shape and includes a transverse arch section 642 and a longitudinal section 644. The transverse arch section includes a pair of centrally disposed lightening apertures 646 circumscribing the tread patches 620 and 622 (FIG. 29). The lightening apertures are interposed between a primary sliding track 650 and a narrower secondary sliding track 652 (FIGS. 29, 31–32). A roughly diamond shaped, thin, connective bridge 654 connects each track and also separates the lightening apertures. The lateral sides of each track of each track curve inwardly. Spaced upwardly and outwardly at an angle of about 35–45 degrees from a horizontal plane passing through the primary track is a longitudinally projecting lateral runner 656. Such lateral inner is spaced about an inch apart from the primary slide track near their point of greatest separation. On the opposing side of the transverse section of the sliding plate is a longitudinally projecting medial runner 658 which is spaced upwardly and outwardly from the outermost edge of the secondary track at an anile of about 20–30 degrees from a horizontal plane passing through the secondary slide track. At their greatest separation, the secondary slide track and medial runner are about one inch apart. Interposed between each track and its respective rail is a concave scalloped region 660 which removes unnecessary material and contributes to the overall lightness of the grinding shoe apparatus. Each scalloped region continues for about four to four and one-quarter inches long with the widest portion near the longitudinal center and converge at their respective foremost and rearmost points. It will be appreciated that the athlete could slide along a support surface using any of the tracks or runners depending on the individual's skill level.

Intersecting the transverse plate section 642 is a longitudinal plate section 644 which includes a heel plate 662 extending from the rear of the transverse plate centrally across the heel of the shoe and partially wraps up onto the vertical trailing edge of the outsole 602 and midsole 604 (FIGS. 28–29). Opposing the heel plate and projecting forwardly from the transverse arch plate is forefoot plate 664 projecting all the way to the toe of the shoe and wrapping upwardly onto the front surface of the outsole. The forefoot plate includes a transversely running flexion break 666 spacing apart the foremost portion 663 of the forefoot plate from that portion 665 of the plate which is connected to the transverse arch plate. The break or weakened area is advantageously placed beneath the ball of the foot which is an area of concentrated flexion during running activities to act as a hinge and allow the foremost portion of the longitudinal plate to independently flex relative to the rest of the longitudinal plate. By incorporating the weakened area 666 into the sole, the forefoot plate sections 663 and 665 which normally lie in substantially the same horizontal plane, may be rotated in opposite directions about the flexion break in conjunction with the flexing of the sole. The flexion break includes an enlarged central section interposed between the forefoot longitudinal plates. On either side of the longitudinal plates, the flexion break narrows to a transversely projecting groove recessed into the bottom surface of the outsole of the shoe. Projecting throughout the longitudinal plate is a central groove 668 that may be used to center the athlete's foot when sliding over very narrow surfaces such that balance is more easily maintained. It is preferable to round the corners where the longitudinal plate sections intersect the transverse plate section to accommodate a smoother transition from one foot position to another and minimize the chance of inadvertently snagging a sharp surface.

Other hinge sections may be incorporated to further enhance the flexibility of the longitudinal plate sections. In this illustration there are four such hinge sections 667 located at each juncture where the longitudinal plate 644 intersects the transverse plate 642 and forward and rearward extremities of each respective primary 650 and secondary 652 slide tracks. Such hinge points include a relatively thin contoured joint having one portion projecting inwardly from the respective primary and secondary slide tracks to transition forwardly or rearwardly along the longitudinal track path providing a smooth transition from the transverse plate to the longitudinal plate. The thickness for each hinge may be varied depending on the needs of the athlete to provide more or less relative movement between the longitudinal plate sections. The hinge sections 667 also allow the respective longitudinal plate sections to bend relative to the transverse plate 642 to more accurately follow the bent contour induced on the flexible sole upon flexion of the foot.

In operation, the wearer may use the grinding shoe device 600 in a manner similar to that already discussed as for example in connection with FIGS. 17–20. It will be appreciated that advantageous placement of the flexion break 666 under the ball of the foot provides enhanced running performance due the increased flexibility between the forefoot and the remainder of the foot.

In other words, the incorporation of the flexion break acts as a hinge connecting the foremost section 663 of the forefoot plate 664 to the rearmost section 665 of the forefoot plate while allowing relative movement between the two components of the forefoot plate. For instance as the athlete runs along the ground in preparation for driving the grinding device onto a rail, the heel will come off the ground while the forefoot remains on the ground. The natural pivot point is near the ball of the foot under which is advantageously placed the flexion break. Such break allows the forefoot to remain on the ground as the heel comes off the ground and does not inhibit normal running motions. This hinge feature significantly improves the wcarer's ability to enter into a normal running gait prior to jumping onto a rail. Once the athlete is sliding along a rail or other support surface, the flexion break further enables the foremost portion of the forefoot plate to flex downwardly or upwardly independently of the rearmost portion of the forefoot plate thereby markedly improving the wearer's ability to track or keep the grind plate in contact with an uneven support surface.

Other means of providing relative movement between sections of the longitudinal plate may also be suitable. For instance, referring now to FIGS. 33–35, an alternate embodiment is illustrated which generally includes a grinding shoe device, generally designated 700, having an upper 701 indicated by phantom lines, supported on a flexible sole comprised of a midsole 704 overlying a flexible outsole 702. The outsole includes a tread surface 706 configured with a high coefficient of friction to provide increased traction over the rigid support surfaces generally encountered during daily activities. The tread surface is broken in two areas defining a transverse recess 710 that spans the width of the outsole generally in the arch area of the shoe and an intersecting longitudinal recess 726 which projects from the forward extremity of the toe region to the rearward extremity of the heel region of the outsole.

Secured within the transverse recess 710 is a transverse sliding plate 714 that projects across the width of the recess. The transverse plate is generally arcuately shaped when viewed in longitudinal cross section and includes a bottom surface having a low coefficient of friction for sliding over rigid support surfaces.

A segmented longitudinal sliding plate 716 is nested within the longitudinal recess and includes a forward section 718 projecting from the forward extremity of the transverse plate 714 to the foremost extremity of the longitudinal recess. A rear portion 720 of the longitudinal plate projects from the rearmost extremity of the transverse plate to the rearmost portion of the longitudinal recess. The plate sections are typically bonded or mechanically fastened to the underlying sole. Both portions of the longitudinal plate are generally arcuately shaped when viewed in transverse cross section. Equidistantly and longitudinally spaced throughout the longitudinal plate sections are a plurality of grooves or flex points 730. The flex points project transversely through the longitudinal plate sections and are about 1–2 inches wide. Six of these grooves are placed in the forward section 718 and three are located in the rear section 720. At each of these points, an upwardly projecting groove is formed that separates adjacent plate sections near the lowermost extremity of the plate. The grooves do not completely separate adjacent plate segments and each groove terminates at its apex against a flexible bridge 738 that joins adjacent longitudinal plate segments. The bridges are made of thin plastic about 2 mm in height constructed to withstand repeated flexion over a period of time. Each respective bridge acts as a hinge between respective adjacent longitudinal plate sections. It will be appreciated that the bridges may be omitted and adjacent plate segments spaced apart by a narrow gap and the segmented plate will then flex as the shoe sole is flexed. The joining of the adjacent segments however facilitates placement of adjacent plates without concern about placement in spacing them apart. It will be appreciated that the number and spacing of the grooves could vary and that longer or smaller bridges could be used.

Set forth around the periphery of the tread surface is a lateral slide surface 740 that is formed with a lip wrapped underneath the sole of the shoe and an laterally outwardly facing portion to allow the athlete to alternatively slide along the outer surfaces of the sole.

During use of this grinding shoe apparatus, the number of flex points 730 contributes significantly to the overall flexibility of the shoe. As the wearer runs, the longitudinal plate sections may flex substantially in accordance with the flexible sole. While flexion typically is greatest in the forefoot area, the addition of flex points in the heel area allows the wearer to lift the front of the shoe up away from the rail while maintaining some contact between the longitudinal slide surface in the heel section and the rail. This may useful in transitioning to adjacent sections of a rail which may have different inclinations.

Figure 36:
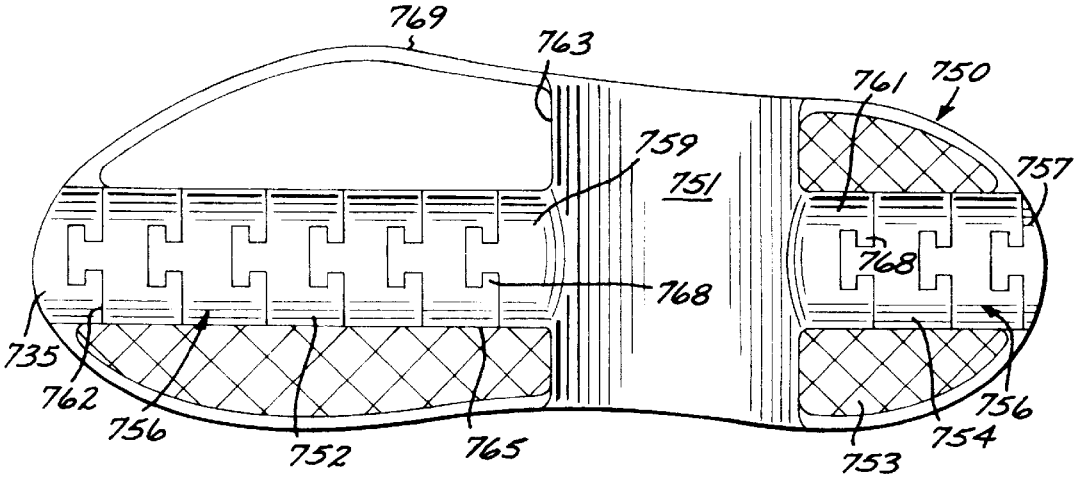
FIG. 36 is a bottom plan view of a modification of the grinding shoe apparatus shown in FIG. 34.
Figure 37:
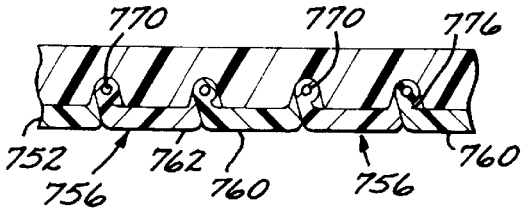
FIG. 37 is a longitudinal sectional view, in enlarged scale, taken along the lines 37—37 of FIG.

The structure shown in FIGS. 36–37 illustrates an alternate means for introducing flexibility into the longitudinal plate. In this embodiment, the grinding shoe apparatus, generally designated 750, includes a tread surface 753 formed on the lowermost extent of the outsole which is interrupted by a transverse recess 763 and intersecting longitudinal recess 765. Set within respective recesses is a transversely projecting arch plate 751 intersecting a longitudinally projecting track formed by a forefoot track 752 and heel track 754. A plurality of interconnected track segments, generally designated 756 are provided in both tracks and are placed in longitudinal alignment between a pair of specially configured leading 755 and trailing edge 757 tracks positioned at opposing ends of the sole. A forward transition track 759 connects the forward edge of the transverse arch plate to the forefoot track and a rearward transition track 761 secures the heel track to the rearward edge of the arch plate.

For those track segments 756 that are adjacent to two other track segments, which in this instance includes five such segments in the forward section of the longitudinal plate and two such sections in the heel portion of the longitudinal plate, their construction is as follows. Each of these track segments 756 includes a lower surface 760 with a low coefficient of friction for sliding along a pipe rail or other rigid support surface. The forward and trailing edges of each individual track are preferably rounded to overcome sharp protuberances that may occur in the support surface. This surface can be substantially flat or may be arcuately shaped when viewed in transverse cross section to accommodate surfaces that are curved in some manner. The forward portion of the track segment includes a planar leading edge 762 that abuts the planar trailing edge 764 of the adjacent preceding track segment. Because these edges are rotated against one another, a slight degree of curvature may be added to improve the rotating relationship between adjacent track segments. Projecting forwardly of the leading edge and upwardly from the bottom surface is a T-shaped boss 766 configured to complement a boss receiver prong 768 in the adjacent preceding track segment. A through bore running through the boss 766 and prong 768 is dimensioned to receive a hinge pin 770 so that adjacent track segments are hinged together. Each track segment is then moveable relative to the adjacent track segments.

Each of the specially configured tracks provides a transition from the sole or arch plate to the full track segments designated 756. The leading edge track 755 includes a forward edge formed with inwardly concave curvature to blend with the normal curvature of the sole in the toe area. This forward edge may wrap up onto the toe of the shoe providing a sliding surface when the toe of the foot is pointed substantially straight down. The rear edge of the this track segment includes a receiver prong 768 for receipt of the boss 766 of the immediately adjacent track. The trailing edge track 757 is formed with a rearmost edge that resembles the outer heel contour of the sole and may also wrap upwardly onto the sole to provide a laterally outward facing slide surface. At the opposite end of this track segment is a boss 766 to be pivotally coupled to the track immediately adjacent. The forward transition track 759 projects from the arch plate 751 and is contoured to provide a smooth transition between the arch plate arcuate trough and the forward track. The front edge of this track is formed with a boss 766 to pivotally engage the immediately adjacent track segment. Another specialized track segment is the rearward transition track segment 761 which is formed with a frontal edge configured with an upwardly projecting curved wall blending into the wall of the arch plate. Such track segment is further formed with a prong 768 to engage to T-shaped boss of the adjacent track segment. These four specially configured track segments cooperate to anchor the respective forefoot and heel tracks to the sole of the shoe and the arch plate. It is further contemplated that lateral slide elements 769 may be incorporated around the periphery of the sole for engaging the sides of the shoe with the slide surface.

Figure 38:
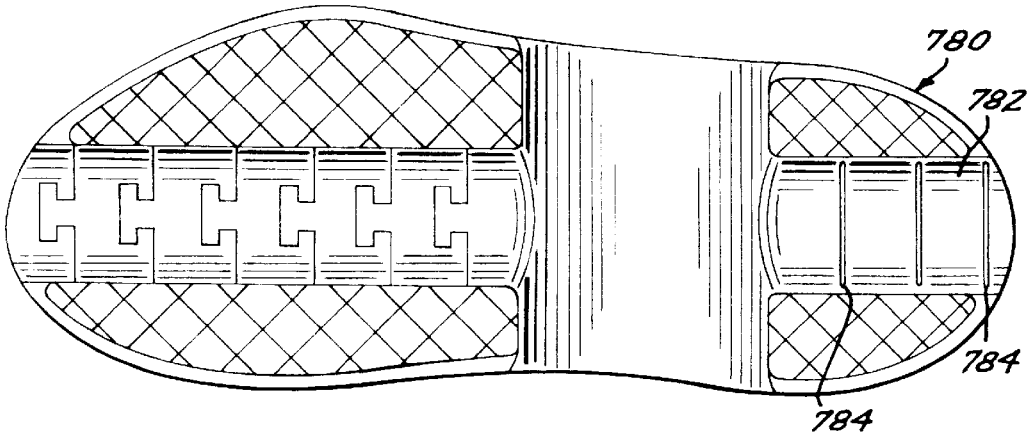
FIG. 38 is a bottom plan view of a modification of the grinding shoe device shown in FIGS. 34 and 36.

It will be appreciated by those of ordinary skill in the art that combinations of flexible elements may be incorporated into a single shoe. For instance, as shown in FIG. 38 for illustrative purposes, a shoe, generally designated 780, is constructed similarly to the shoe illustrated in FIGS. 36–37 described above includes a modified heel track 782 constructed with the longitudinally spaced, laterally projecting flex grooves 784 as described above for the embodiment in FIGS. 33–35. A reversal of these components could be used to accommodate different wearers. Thus different flexion characteristics may be achieved through the incorporation of alternative longitudinal track constructions.

Figure 33:
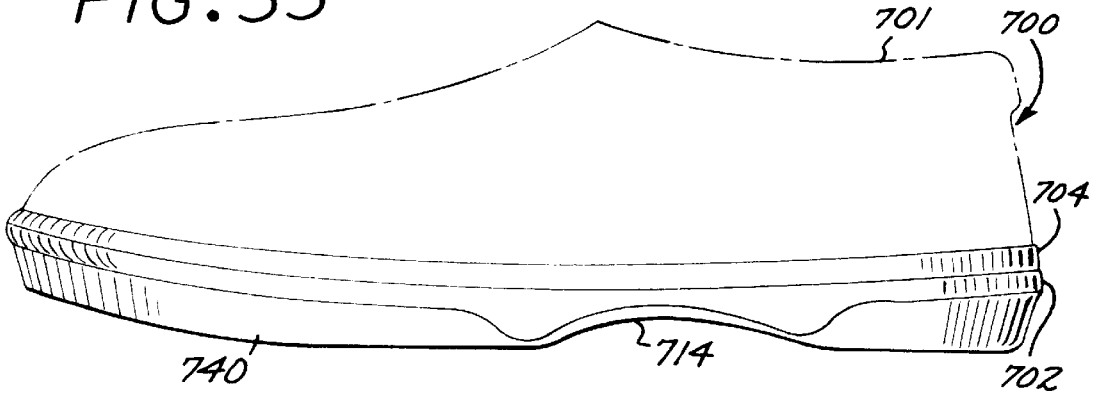
FIG. 33 is a medial side view of a fifteenth embodiment of the grind shoe apparatus of the present invention.
Figure 34:
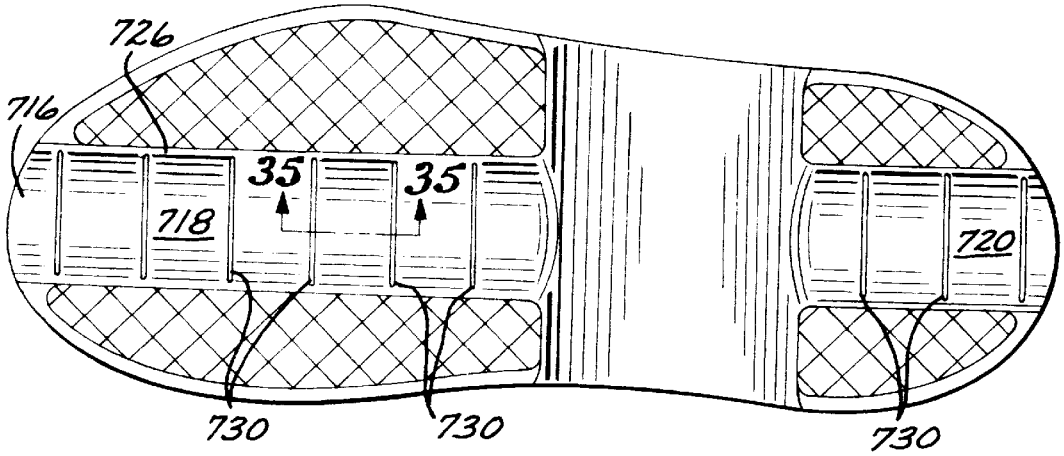
FIG. 34 is a bottom plan view of the grinding shoe apparatus shown in FIG. 33.
Figure 35:
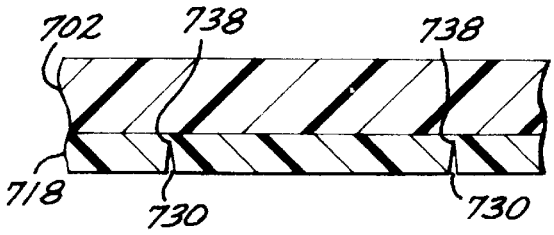
FIG. 35 is a longitudinal, sectional view, in enlarged scale, taken along the lines 35—35 of FIG. 34.

It will be appreciated that the operation of such a grinding device as exemplified in FIGS. 36–38 is substantially the same as discussed for FIGS. 33–35. The pivotal connection between track segments 756 allows a smooth ride over a relatively bumpy support surface due to the degree of rotation of each track segment in the clockwise and counterclockwise directions. Each track segment may rotate both clockwise and counterclockwise about their respective pivot pin 770 as viewed in FIG. 37 and are constricted in the degree of rotation only by the inherent flexibility of the sole and interference of the abutting surfaces from each track segments. By spacing confronting surfaces further apart, greater rotational movement of each segment about the pivot pin may be increased such that significant undulation of the longitudinal track sections 752 and 754 may be induced while grinding.

It may be useful in some circumstances to avoid the use of mechanical fasteners and use bonding material as a suitable replacement or locate the recesses in different locations within the sole. As is illustrated in FIGS. 39–40, a shoe, generally designated 800 is provided for normal walking and running activities as well as sliding in multiple orientations over rigid support surfaces. The shoe includes an upper 802, indicated by phantom lines and a sole 804 including a broken tread surface 806 receding upwardly into the sole to form a transverse channel 810 and a longitudinal channel 812. The transverse channel projects across the sole of the shoe at an angle such that the medial side of the channel is disposed forwardly of the lateral side of the channel. The channel is positioned in the forward region of the sole to pass substantially beneath the ball of the foot of the athlete while wearing the grinding shoes. Disposed within and adhered to the transverse channel is a transverse plate 814 for sliding over rigid support surfaces in a substantially perpendicular direction to the longitudinal orientation of the sole. This plate is narrower than the transverse plate previously discussed. Because of the narrower plate and position beneath the ball of the foot, a greater sense of balance is required to operate a shoe incorporating such plate.

Intersecting the transverse channel 810 is a longitudinal channel 812 that stretches from the toe to the heel of the sole and divides the transverse channel into substantially equal parts. Recessed upwardly into the longitudinal channel is a longitudinal plate 816 that substantially occupies the channel. The longitudinal plate is generally made of thin durable plastic and is flexible to flex with the sole of the shoe as the wearer performs daily activities such as walking or running. The adhesion of the plates to the sole equates to a transfer of the flexing forces directly from the sole to the plate. Consequently, the flexibility of the plate ensures that the adhesive fit will not be compromised and the plate will continue to adhere to the sole. Further sliding maneuvers are facilitated by peripherally mounted lateral slide plates. Such plates include a heel plate 815 curving outwardly and forwardly from both sides of the rearmost portion of the longitudinal plate to follow the contour of the heel section of shoe to terminate near the arch of the shoe and a forefoot plate 817 which curves outwardly and rearwardly from the foremost point of both sides of the longitudinal plate to sweep along the sides of the shoe beyond the transverse plate to terminate in about the arch section of the shoe. Thus an athlete may contact the sides of the shoe with these plates and maintain sliding engagement with the Support surface enabling additional foot positions during maneuvers.

The operation of such shoe depicted in FIGS. 39–40 is substantially the same as that provided for FIG. 19 keeping in mind that greater balance is required because of the placement of a smaller transverse plate beneath the ball of the foot. For example, the athlete may don shoes incorporating the transverse and longitudinal grinding plates 814 and 816 and select placement of each foot in either a direction parallel with the direction of travel or at a slightly skewed angle not quite perpendicular to the direction of travel while jumping onto a rail and driving the desired plate into contact with the rail. The athlete may continue to slide along the support surface while selecting alternative foot positions or even electing to remove one foot entirely from the rail or use the lateral slide surfaces to contact the rail. The flexibility of the longitudinal plate assists the athlete when encountering transitional inclined surfaces or during running to start the sliding maneuver.

Figure 41:
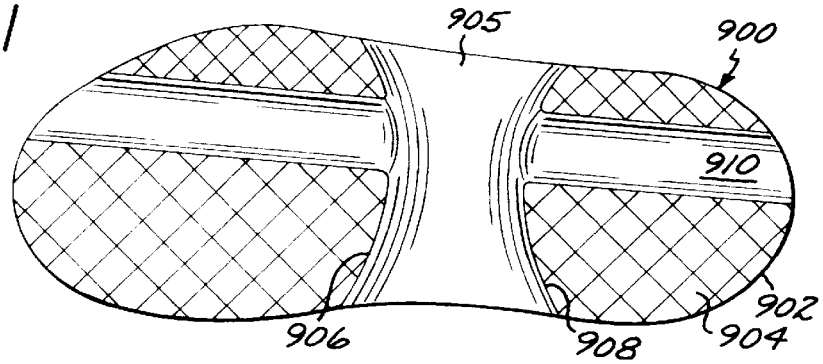
FIGS. 41 through 52 are respective bottom plan views of various modifications of the grinding shoe apparatus shown in FIG. 17.
Figure 42:
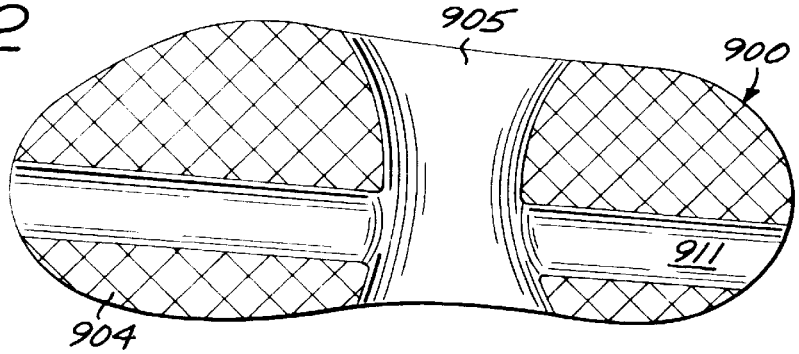
Figure 43:
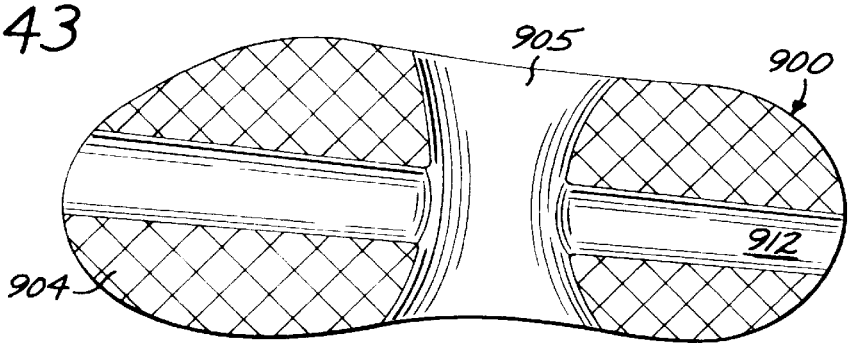

It will be appreciated that a variety of plate configurations may be incorporated into the sole of a shoe to accommodate a variety of grinding maneuvers and customer demands. FIGS. 41–52 illustrate a few alternative designs that are within the scope of the present invention. All of the embodiments shown in these figures generally include a shoe, generally designated 900 with a sole 902 having a tread surface 904 of varying shape to accommodate the varying sliding plates. In FIGS. 41–44, a transverse plate 905 is complementally received in a transverse recess which spans the width of the shoe sole. The forward edge 906 and trailing edge 908 of the transverse plates include an outwardly convex curvature when viewed from a lateral center plane of the transverse plate. In other words, the apex of the forward and trailing edges are in the closest proximity and the lateral and medial sides of the plate define the points of farthest proximity. While the transverse plate is generally the same construction and in the same position under the arch area of the sole, the position of the longitudinal plate varies to accommodate differing balancing preferences of the athletes. Different balance preferences demand a variety of positioning of the lateral and longitudinal plates and intersection therebetween. As illustrated in FIG. 41, the longitudinal plate 910 projects generally from the toe to the heel as slightly off-centered with a proximity to the lateral side of the shoe. FIG. 42, on the other hand, depicts a longitudinal plate 911 which is closer to the medial side of the shoe. FIG. 43 illustrates a centrally located longitudinal plate 912 with the forward edge being slightly closer to the lateral edge of the shoe than the rear edge near the heel.

Figure 44:
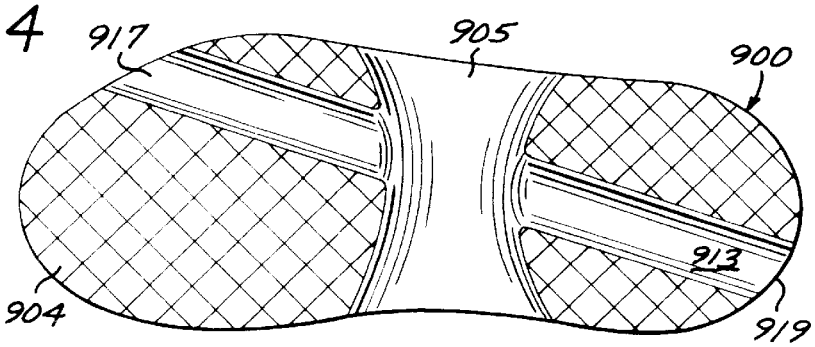
Figure 45:
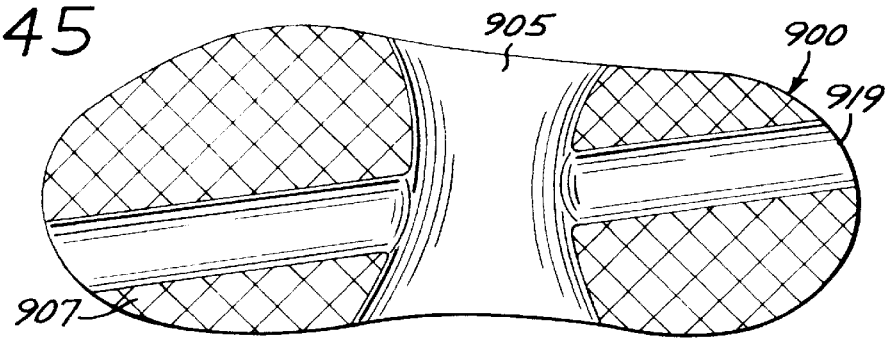

As further illustrated in FIG. 44, the orientation of the generally longitudinal plate may vary as well. Instead of running perpendicularly to the transverse plate 905, the longitudinal plate 913 is skewed and angled about 15 degrees from a longitudinal center line with the forward edge 917 of the plate terminating on the forward lateral side of the shoe and the trailing edge 919 terminating near the rearward medial side of the shoe. FIG. 45 depicts a shoe incorporating a similar plate with the exception that the longitudinal plate is skewed about 15 degree the other way such that the toe edge 917 ends near the forward medial edge of the sole and the heel edge 919 terminates in the rearward lateral edge area.

Figure 46:
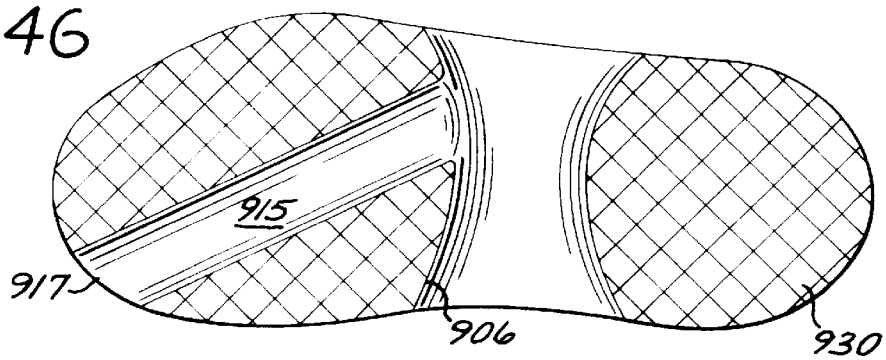
Figure 47:
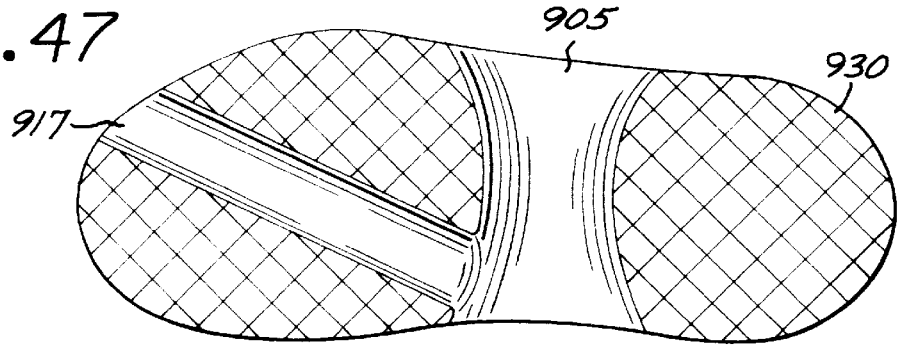

Other embodiments may also be incorporated the flexible longitudinal plates. Referring now to FIGS. 46 and 47, the transverse plate could be any construction described herein. As shown in FIG. 46, a longitudinal plate 915 projects forwardly at an angle of about 15 degrees from the leading edge 906 of the transverse plate with its laterally outermost edge beginning about one inch from the lateral side of the shoe. The forwardmost edge 917 of the longitudinal plate terminates near the forward medial edge of the shoe. FIG. 47 depicts a minor image with the longitudinal plate forward edge 917 terminating in the forward lateral edge of the shoe. There is no longitudinal plate disposed in the heel section in these embodiments. The angle of the longitudinal plates assures that the heel tread 930 will not interfere with the rigid surface as it passes clear of the heel section.

Figure 48:
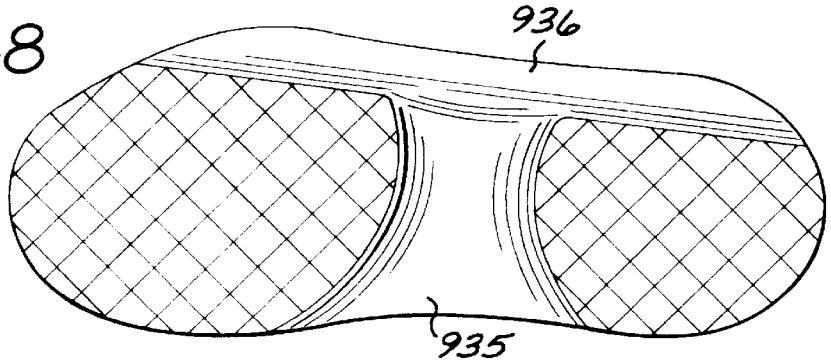

Now referring to FIG. 48, wherein, the transverse plate 935 is intersected by the longitudinal plate 936 at the lateral side of the shoe. On the opposing medial side, the transverse plate is widely flared to accommodate a wide range of rotation about the plate's central transverse axis. It is preferable to incorporate a narrow longitudinal plate along the side of the shoe so that normal walking and running functions are not compromised. However, it will be appreciated, as with all these shoes, if normal walking and running functions are not intended and thc shoe is primarily designed for grinding or sliding maneuvers, then the plates could be made larger, project below the tread plane, or the tread could be removed altogether.

Figure 49:
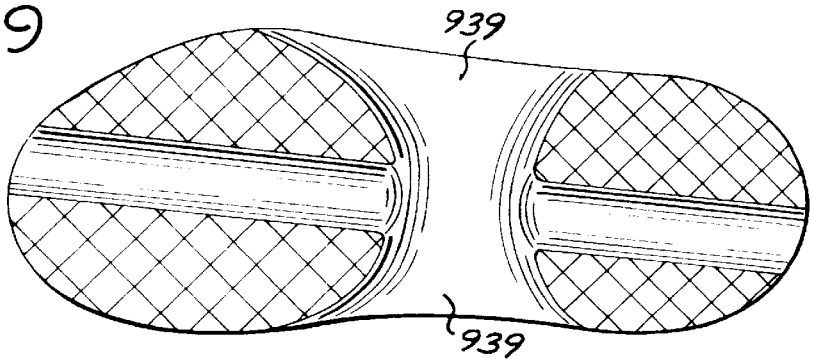

The increasing flared regions 939 of the transverse plate are evident on both sides of the plate in FIG. 49. As shown in FIG. 49 the lateral and medial sides of the transverse plate project a greater length in the longitudinal direction than the previously described transverse plates. In combination with the intersecting longitudinal plate, this shoe provides a greater transitional sliding surface.

Figure 50:
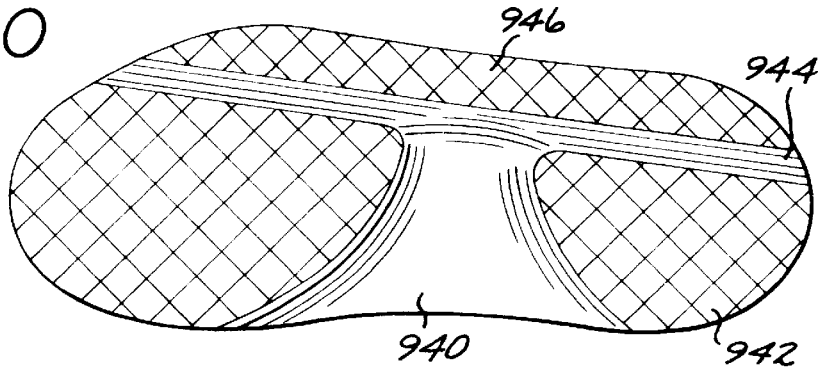

Referring now to FIG. 50, a transverse plate 940 is shown that spans the majority of the width of the sole 942. The lateral side of the transverse plate, however terminates in a narrow longitudinal extension 944 that projects from the toe to the heel and functions as a longitudinal sliding plate. An additional tread patch 946 is disposed on the lateral outside edge of the longitudinal plate.

Figure 51:
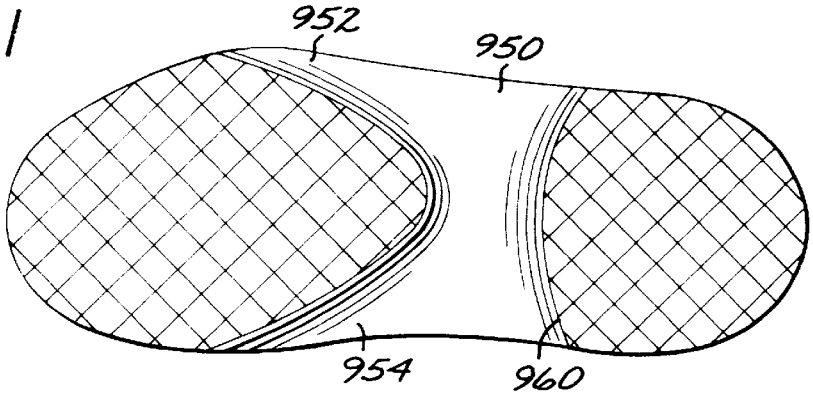
Figure 52:
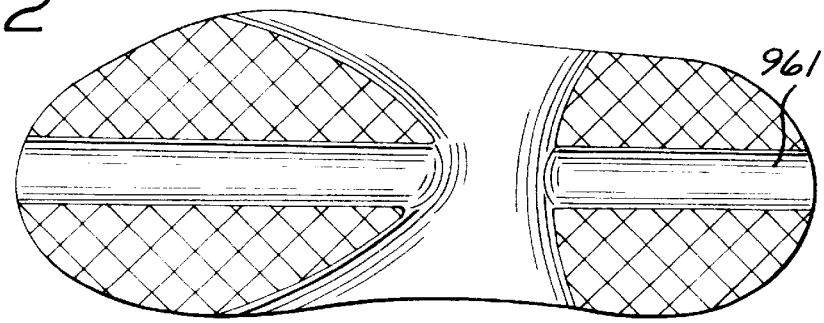

Another feature of the grinding shoe apparatus of the present invention is the provision of a transverse sliding element 950 with laterally and medially forwardly projecting sliding surfaces. As depicted in FIG. 51, a pronounced forward sweeping of the leading edge of the transverse plate defines a lateral slide wing 952 and a medial slide wing 954. The forward most edge of the respective wings terminates about halfway up the forefoot section. The trailing edge 960 of the transverse plate is generally contoured in the form of a rearwardly facing convex curve when viewed from the central transverse axis of the transverse plate. The transverse plate spans the width of the shoe. FIG. 52 depicts a similar transverse plate with the addition of an intersection longitudinal plate 961. It will be appreciated that the longitudinal and transverse plates could be of unitary construction or comprise a plurality of pieces such as discrete transverse and longitudinal plates.

In operation, the wearer dons a pair of grinding shoes incorporating one of the plates described herein and may then generally proceed with daily walking and running activities in a normal manner. Entering into a particular sliding activity requires the location of a desirable rigid support surface such as a curb edge, pipe rail, or other generally elongated narrow surface. Once a desirable sliding surface has been spotted, the wearer may then run up to the surface to gain desired momentum or if the surface is inclined may merely jump onto the rail or curb-like surface and drive either the longitudinal or transverse plates of at least one shoe onto the rail to slide therealong. For example, the wearer may drive both transverse plates of the respective left and right shoes onto the pipe rail and slide in a direction parallel the central axis of the transverse plates. Alternatively, the grinder may drive both generally longitudinal plates onto the rail and slide in a direction parallel with the longitudinal axis of the longitudinal plates. If the desire to use an alternate plate arises, the grinder may momentarily lift one shoe and rotate the ankle to align the alternate plate with the sliding surface and replace the shoe back thereon. Grinders having more experience may be capable of performing such transitions without actually removing the shoe from the rail but instead merely performing an advanced balancing maneuver to transition from the transverse plate to the longitudinal plate or vice-versa.

By shifting one's balance in an appropriate manner, only one shoe at a time may be used for sliding and the other shoe remain free of the rail or other sliding surfaces such as the laterally mounted sliding surfaces as shown in FIGS. 33 and 39 may be used for additional maneuvers. Differing stances that may be preferred by grinders of differing experience levels or those endeavoring to achieve particular maneuvers that require a particular positioning of the feet will dictate the plate configuration chosen.

The flexibility features previously described could be incorporated into any one of these embodiments and still be within the scope of the present invention. Likewise, it will be appreciated that the corners where the two plates intersect are generally rounded off to case the transition between the plates and when the plate is first driven onto the rigid surface. Furthermore, different portions of the plates could be permanently affixed or adhered or other portions removable. It will also be appreciated that during operation, the tread surface can engage the rigid sliding surface to act as a braking element. The forward and rearward sections of the longitudinal plates could also be formed with different widths.

From the foregoing, it will be appreciated that the apparatus of the present invention facilitates performing the acrobatic maneuvers popularly known as grinding by enabling a person wearing shoes adapted for traditional purposes such as walking or running to engage a protruding feature on a supporting surface and slide across such protuberance on low friction surfaces formed on the shoes in selected configurations. The low friction sliding surfaces of the present invention are formed integral to the shoes or attached thereto as removable sliding elements, and are equally adaptable to athletic, work, or recreational footwear of all types and styles. A feature of particular significance resides in the fact that the sliding surfaces of the present invention do not interfere with the traditional functions of footwear and do not require the user to adjust her normal walking or running gait when wearing shoes equipped with such sliding surfaces. The apparatus of the present invention therefore adapts specialized equipment to traditional footwear and thereby enlarges the usefulness of such footwear and the enjoyment level of persons wearing it. The present invention can also be implemented in a wide range of aesthetic and practical choices for design and manufacturing and can thus be adapted to appeal to diverse markets and consumers.

What is claimed is:

1. Grinding shoe apparatus for grinding on a rail or curb and comprising:

a shoe including a flexible sole configured with downwardly facing forefoot and heel tread surfaces with downwardly opening transverse and longitudinal recesses;

a grind plate device for fastening to said sole and including a transverse grind plate section and a longitudinal grind plate section formed on their respective top sides to be complementally received in the respective said transverse and longitudinal recesses and formed with respective downwardly facing low coefficient of friction grind surfaces for, when said grind plate sections are received in the respective said recesses and fastened to said sole, grinding along said rail or curb, said longitudinal grind plate section being constructed of at least two portions configured to move relative to one another upon flexing of said sole whereby a wearer may walk or run flexing said sole and may grind on said rail or curb with the respective said grind surfaces.

2. Grinding shoe apparatus of claim 1 wherein:

said longitudinal grind plate section includes forward and rearward portions configured to flex relative to one another.

3. Grinding shoe apparatus of claim 1 wherein:

said longitudinal grind plate section is concave in transverse cross section to form a longitudinally extending, downwardly opening trough defining a longitudinally extending said grind surface.

4. Grinding shoe apparatus of claim 1 wherein:

said recesses and grind plate sections are arranged in a cruciform pattern.

5. Grinding shoe apparatus of claim 1 wherein:

said longitudinal grind plate section includes discrete forward and rearward grind plate portions.

6. Grinding shoe apparatus of claim 1 that includes:

fastener means for fastening said grind plate sections to said sole.

7. Grinding shoe apparatus of claim 1 that includes:

fastening devices for fastening said grind plate sections to said sole.

8. Grinding shoe apparatus of claim 1 wherein:

at least one of said grind plate sections is bonded to said sole.

9. Grinding shoe apparatus of claim 1 wherein:

said longitudinal grind plate section extends rearwardly of the arch of said sole.

10. Grinding shoe apparatus as set forth in claim 1 wherein:

said longitudinal grind plate section projects forwardly of an arch section of said sole.

11. Grinding shoe apparatus as set forth in claim 1 wherein:

said longitudinal grind plate section projects to a toe section of said sole.

12. Grinding shoe apparatus as set forth in claim 1 wherein:

said longitudinal recess projects from a heel section to a toe section of said shoe; and said longitudinal grind plate section projects from said toe section to said heel section of said sole.

13. Grinding shoe apparatus as set forth in claim 1 wherein:

said sole is formed with said transverse recess projecting under a ball region of said sole; and said transverse grind plate section is received in said transverse recess and projects from one side of said sole to the other.

14. Grinding shoe apparatus as set forth in claim 1 wherein:

said transverse and longitudinal grind plate sections are formed with downwardly opening troughs defining the respective grind surfaces.

15. Grinding shoe apparatus as set forth in claim 1 wherein:

said transverse grind plate section is formed on its opposite sides with upwardly and outwardly angled, longitudinally extending grind plate runners.

16. Grinding shoe apparatus as set forth in claim 1 wherein:

said longitudinal grind plate section includes flexible sections.

17. Grinding shoe apparatus as set forth in claim 1 wherein:

said longitudinal grind plate section is formed with one or more openings therein.

18. Grinding shoe apparatus as set forth in claim 1 wherein:

said sole is formed with at least one transversely extending flex groove disposed at a predetermined location in said sole; and said longitudinal grind plate section includes forward and rearward portions projecting forwardly and rearwardly of said predetermined location.

19. Grinding shoe apparatus as set forth in claim 1 wherein:

said longitudinal section includes an upwardly raised, downwardly opening trough and includes a longitudinally extending, downwardly opening groove disposed centrally therein.

20. Grinding shoe apparatus as set forth in claim 1 wherein:

said longitudinal recess is formed with a generally arcuate transverse cross-section and is formed at its lateral opposite sides with laterally outwardly disposed, downwardly opening longitudinal extending notches, and wherein:

said longitudinal grind plate section is formed with an arcuate top side for complementally fitting said longitudinal recess and includes laterally outwardly disposed, longitudinally extending flanges nested in said notches.

21. Grinding shoe apparatus as set forth in claim 1 wherein:

said transverse grind plate section includes flanking, generally outwardly disposed longitudinal grind rails which angle upwardly and outwardly to be formed with downwardly and laterally outwardly facing grind surfaces.

22. Grinding shoe apparatus as set forth in claim 1 wherein:

said longitudinal grind plate section includes a plurality of longitudinally aligned grind plate portions connected together by flexible hinge.

23. Grinding shoe apparatus as set forth in claim 1 wherein:

said longitudinal grind plate section includes a plurality of longitudinally aligned discrete grind plate portions and hinges connecting said portions together.

24. Grinding shoe apparatus as set forth in claim 23 wherein:

said hinges include aligned hinge bosses and prongs with hinge pins connecting said bosses and prongs together.

25. Grinding shoe apparatus as set forth in claim 1 wherein:

said longitudinal recess is disposed centrally in said sole and projects longitudinally from a toe section to a heel section of said sole and said transverse recess projects laterally across a ball region of said sole; and said longitudinal grind plate section includes a trough projecting from said heel section to said toe section of said shoe and said transverse grind plate section includes a trough projecting from one side to the other of said shoe.

26. Grinding shoe apparatus as set forth in claim 25 wherein:

said grind plate device includes peripheral grind plate sections extending along at least one side of said toe section of said sole.

27. Grinding shoe apparatus as set forth in claim 25 wherein:

said grind plate device includes a peripheral grind plate section extending along at least one transverse side of said heel section.

28. Grinding shoe apparatus as set forth in claim 1 wherein:

said sole is formed with said longitudinal recess extending along one side of said sole; and said longitudinal grind plate section is configured to be received in said longitudinal recess extending along said one side of said sole.

29. Grinding shoe apparatus as set forth in claim 1 wherein:

said sole is formed with said longitudinal recess disposed laterally to one side of said sole and projecting from a toe section to a heel section thereof; and said longitudinal grind plate device is configured to be received in said longitudinal recess and projects from said heel section to said toe section of said sole.

30. Grinding shoe apparatus as set forth in claim 1 wherein:

said sole is formed with said longitudinal recess disposed to a lateral side of said sole and projects from a heel section to a toe section thereof, and said longitudinal grind plate section is configured to be received in said longitudinal recess and projects from said heel section to said toe section of said shoe.

31. Grinding shoe apparatus as set forth in claim 1 wherein:

said sole is formed so that said longitudinal recess projects diagonally from a heel section to a toe section; and said longitudinal grind plate section is configured to be received in said longitudinal recess and projects from said heel section to said toe section.

32. Grinding shoe apparatus as set forth in claim 31 wherein:

said longitudinal recess projects from a medial side of said heel section to a lateral side of said toe section.

33. Grinding shoe apparatus as set forth in claim 31 wherein:

said longitudinal recess projects from a lateral side of said heel section to a medial side of said toe section.

34. Grinding shoe apparatus as set forth in claim 1 wherein:

said longitudinal recess projects from an arch section of said sole to a toe section of said sole.

35. Grinding shoe apparatus as set forth in claim 1 wherein:

said longitudinal recess projects from an arch section of said sole diagonally to a medial side of a toe section of said sole.

36. Grinding shoe apparatus as set forth in claim 1 wherein:

said longitudinal recess projects from an arch section at a medial side diagonally to a lateral side of a toe section; and said longitudinal grind plate is configured to be received in said longitudinal recess and projects to said toe section.

37. Grinding shoe apparatus as set forth in claim 1 wherein:

said longitudinal grind plate section projects longitudinally and wherein said sole is configured to project said longitudinal recess longitudinally along one side of said sole; and said longitudinal grind plate section is configured to be received in said longitudinal recess and project from a heel section to a toe section of said sole.

38. Grinding shoe apparatus as set forth in claim 1 wherein:

said sole is formed in said transverse recess of an arch section thereof and is formed with rear walls which curve laterally and medially outwardly and rearwardly and with a forward wall which curves laterally and medially outwardly and longitudinally forwardly and said longitudinal recess projects longitudinally and centrally in said sole; and said transverse grind plate section is configured with forward and rearward walls configured to complementally fit the forward and rearward wall of said recess and is formed with said longitudinal grind plate projecting in said longitudinal recess from a heel section to a toe section of said sole.

39. Grinding shoe apparatus as set forth in claim 1 wherein:

said transverse recess extends from one side of said sole and terminates short of the opposite side thereof and terminates in a side wall faced from the opposite side of said sole;

said sole is further formed with said longitudinal recess projecting longitudinally of said transverse recess and intersecting said transverse recess at said side wall; and said transverse and longitudinal grind sections are configured to be complementally fitted in said transverse and longitudinal recesses.

40. Grinding shoe apparatus as set forth in claim 1 wherein:

said longitudinal recess includes recess sections extending forwardly on opposite sides of said sole from an arch section of said sole to a transverse line under a ball region of said sole; and said transverse grind plate section is configured to fit under said arch section of said sole and said longitudinal section includes laterally oppositely disposed sections projecting forwardly of said sole of said arch section to said transverse line.

41. Grinding shoe apparatus according to claim 40 wherein:

said sole is formed with a further longitudinal recess disposed centrally in said sole.

42. Grinding shoe apparatus as set forth in claim 41 wherein:

said further longitudinal recess projects longitudinally from the heel to the toe of said sole.

43. A method of manufacturing a grind shoe including:

making a shoe including a flexible sole configured with downwardly facing forefoot and heel tread surfaces and including downwardly opening transverse and longitudinal recesses;

making a grind plate device including a transverse 2rind plate section and a longitudinal grind plate being constructed of at least two sections configured to move relative to one another upon installation for receipt in the respective said transverse and longitudinal recesses and forming such grind plate sections on their top sides for being complementally received in the respective said transverse and longitudinal recesses;

installing said grind plate device by inserting said transverse grind plate section in said transverse recess and inserting said longitudinal grind plate sections in said longitudinal recesses; and fastening said grind plate device to said sole.

44. The method as set forth in claim 43 further including:

manufacturing said sole with said transverse recess including front and rear vertical walls; and said step for making said grind plate includes making said grind plate with front and rear abutment walls for complementing the respective forward and rearward recess walls.

45. The method as set forth in claim 43 that includes:

manufacturing said sole with said longitudinal recess extending a full length of said sole; and said step of making said grind plate device includes making said longitudinal grind plate section to be flexible for flexing with said sole.

46. The method as set forth in claim 43 that includes:

manufacturing said longitudinal grind plate section in discrete longitudinal grind plate portions.

47. The method as set forth in claim 43 that includes:

manufacturing said longitudinal grind plate section with hinge elements to facilitate flexing of said flexible sole.

48. Shoe grinding apparatus for grinding over a curb or rail and comprising:

a flexible shoe including a sole configured with a downwardly facing tread surface formed with a downwardly opening longitudinal tunnel; and a longitudinal grind plate device configured on its top side to be complementally received in said tunnel and including discrete forward and rearward sections arranged fastened to said sole to flex relative to one another as said sole is flexed.

49. Grinding shoe apparatus for sliding over an elongated support surface comprising:

a flexible shoe sole configured with a downwardly facing tread surface formed with a downwardly facing longitudinal channel formed with a transversely projecting weakened section; and a longitudinal grind plate formed with a first plate section and second plate section aligned in a substantially horizontal plane and mounted in said channel with said weakened section interposed therebetween whereby, upon flexing of said sole about said weakened section said first plate section is rotated about said weakened section in an opposite direction of rotation than said second plate section.

50. Grinding shoe apparatus for sliding along an elongated support surface comprising:

a flexible sole having a toe region and a heel region formed with a first recess projecting longitudinally throughout said regions and intersecting a second recess running transversely across said sole;

a thin longitudinal plate including first and second sections disposed within said first recess;

an arcuate transverse plate intersecting said longitudinal plate and configured with a top surface to be complementally nested within said second recess;

said plates being formed with downwardly facing low coefficient of friction slide surfaces to be driven into contact with said support surface for sliding therealong; and a transversely projecting hinge element pivotally coupling said first and second sections, whereupon flexing of said sole about said hinge element, said sections rotate in opposite directions about said hinge element.

* * * * *